US006645688B2

(12) United States Patent
Hashizume et al.

(10) Patent No.: US 6,645,688 B2
(45) Date of Patent: Nov. 11, 2003

(54) IMAGE-FORMING APPARATUS AND IMAGE-FORMING METHOD

(75) Inventors: Junichiro Hashizume, Shizuoka (JP); Ryuji Okamura, Shizuoka (JP); Kazuto Hosoi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 29 days.

(21) Appl. No.: 09/987,507

(22) Filed: Nov. 15, 2001

(65) Prior Publication Data

US 2002/0098438 A1 Jul. 25, 2002

(30) Foreign Application Priority Data

Nov. 15, 2000 (JP) ..... 2000-348143
Nov. 15, 2000 (JP) ..... 2000-348144

(51) Int. Cl.[7] ..... G03G 15/04
(52) U.S. Cl. ..... 430/66; 430/124; 399/159
(58) Field of Search ..... 430/66, 124; 399/159

(56) References Cited

U.S. PATENT DOCUMENTS

2001/0051308 A1 * 12/2001 Kawamura et al. ..... 430/66
2002/0037464 A1 * 3/2002 Kawada et al. ..... 430/66

FOREIGN PATENT DOCUMENTS

EP 1 058 157 12/2000
EP 1 134 619 9/2001
JP 63-208878 8/1988
JP 8-6353 1/1996
JP 10-307454 11/1998
JP 11-184121 7/1999

OTHER PUBLICATIONS

U.S. patent application No. 09/987,228, filed Nov. 14, 2001.

* cited by examiner

*Primary Examiner*—Mark A. Chapman
(74) *Attorney, Agent, or Firm*—Fitzpatrick, Cella, Harper & Scinto

(57) ABSTRACT

In an image-forming apparatus having at least i) an electrophotographic photosensitive member having at least a photoconductive layer and a surface layer on a conductive substrate, ii) a developing means having a toner, and iii) a charging means, the photoconductive layer comprises a non-single-crystal material composed chiefly of silicon, the surface layer comprises a non-single-crystal carbon film containing at least hydrogen and has an arithmetic-mean roughness Ra ranging from 0 nm to 100 nm in an extent of 10 $\mu$m×10 $\mu$m of the surface layer, the charging mean is a magnetic-brush charging assembly or an elastic-roller charging assembly holding thereon a conductive fine powder, and the toner is a magnetic toner having toner particles containing at least a binder resin and a magnetic material, and an inorganic fine powder, having an average circularity of from 0.950 to 1.000, and having a saturation magnetization of from 10 to 50 $Am^2/kg$ (emu/g) under application of a magnetic field of 79.6 kA/m (1,000 oersteds). Also disclosed is an image-forming method.

37 Claims, 6 Drawing Sheets

IMAGE-FORMING APPARATUS AND IMAGE-FORMING METHOD

BACKGROUND OF THE INVENTION

1. Field of the Invention

This invention relates to an image-forming apparatus and an image-forming method which make use of an amorphous-silicon electrophotographic photosensitive member, a contact charging means and a spherical toner.

2. Related Background Art

Conventionally, it is common to use corona charging assemblies in charging units for photosensitive members used in, e.g., plain-paper copying machines, laser beam printers, LED printers and liquid-crystal shutter printers, and such corona charging assemblies are in wide use. The corona charging assemblies charge object members electrostatically by applying a high voltage of about 5 to 10 kV to a metal wire of about 50 to 100 $\mu$m in diameter to ionize the atmosphere.

For structural reasons, the corona charging assemblies have a disadvantage that generation of ozone in a large quantity accompanies corona discharging. With their repeated used, ozone and corona products may become deposited on the photosensitive member surface, under the influence of which the photosensitive member surface may become susceptible to humidity to tend to absorb moisture content. This may cause a lateral flow of electric charges on the photosensitive member surface in an environment of high temperature and high humidity to cause a lowering of image quality which is called smeared images. In particular, electrophotographic photosensitive members making use of amorphous silicon (hereinafter "a-Si photosensitive member") have so high a surface hardness that, while they are durable to printing on a large number of sheets, their surfaces may abrade with difficulty. Hence, corona products having once adhered can be removed with difficulty to have a great influence.

The corona charging assemblies are also usually often used under constant-current control. In such a case, they tends to be affected by any uneven layer thickness and resistance distribution of the photosensitive member. This may cause unevenness in surface potential, and may consequently cause uneven density on images.

In order to solve such a problem on image quality, various charging units are proposed.

In a contact charging unit as disclosed in Japanese Patent Application Laid-open No. 63-208878, a charging member to which a voltage is kept applied is brought into contact with an object member to be charged (photosensitive member), which is called charging object member, to charge the photosensitive member surface to an intended potential. Compared with the corona charging assemblies, such a unit can achieve a low voltage in respect of the applied voltage necessary for providing the desired potential on the charging object member surface, and does not cause any smeared images due to the ozone products because the quantity of ozone occurring in the course of charging is zero or is very small. Also, in such contact charging, the surface of the photosensitive member is charged to have substantially a uniform potential in accordance with the applied voltage, and hence uneven image density may little occur. It has such advantages.

In the way of progress such that a series of contact charging members are improved in various manners, as disclosed in Japanese Patent Application Laid-open No. 8-6353, a mechanism is proposed in which a contact charging member making use of particles in the form of a magnetic brush comprised of a magnetic material and magnetic particles (or powder) is brought into contact with an electrophotographic photosensitive member to provide it with charge. Also proposed is, as disclosed in Japanese Patent Application Laid-open No. 10-307454, a new method of a mechanism in which a carrying member having conductivity and elasticity so constructed that charged particles are carried on the surface is brought into contact with a photosensitive member to provide it with charge.

Attempts to achieve much higher image quality are also made from improvements of toners. More specifically, polymerization toners are on studies in place of conventional pulverization toners.

The polymerization toners have superior fluidity because they have particles in substantially a uniform spherical shape and having less scattering in particle diameter. Also, they are advantageous to the achievement of high image quality because they do not let colorants come bare to particle surfaces and have uniform triboelectric chargeability. Still also, they can enclose wax in particles, and can attain good fixing performance and anti-offset properties. Hence, the polymerization toners are being gradually widely employed in high-image-quality machines. As a patent application which proposes a magnetic polymerization toner, EP1058157 A1 is accessible.

In recent years, what also attracts notice is to make image-forming apparatus small-sized. In image-forming apparatus, usually a latent image is developed with a toner to make it into a visible image, the toner image is transfer to a transfer medium such as paper, and thereafter toner particles having remained on a photosensitive member without being transferred onto the transfer medium are removed through a cleaning step. With regard to this cleaning step, blade cleaning, fur brush cleaning, roller cleaning and so forth have conventionally been used. However, from the viewpoint of apparatus, apparatus are necessarily set up in a large size because a unit for such cleaning must be provided. This has been a bottleneck in making apparatus compact.

In addition, from the viewpoint of ecology, the waste toner that comes from the cleaning step is undesirable. In the sense of effective utilization of toners, too, it has been sought to provide a system which does not send forth any waste toner.

As one means for meeting such demands, an image-forming apparatus employing the technique called cleaning-at-development or cleanerless. The cleanerless image-forming apparatus is an apparatus in which any conventional cleaning unit is not provided and the transfer residual toner having remained on the surface of an electrophotographic photosensitive member is collected at its developing means which performs development simultaneously. Employment of this technique makes it possible to save the space for the part of the cleaner, and can contribute towards making image-forming apparatus compact. Also, since any waste toner does not come out, such apparatus have the merit of being tender of environment and improving utilization efficiency of toners.

As stated above, attempts to achieve much higher image quality are being made by combining the formation of uniform latent images free of any unfocused or uneven images that is attributable to contact charging units with the formation of faithful visible images that is attributable to polymerization toners.

However, in the case when the voltage application type contact charging unit is utilized as a means for charging the electrophotographic photosensitive member, there are the following problems.

In such a contact charging unit, it has very good charge potential uniformity when viewed macroscopically as stated above. However, when viewed microscopically, for the reasons of its construction, marks of contact of the magnetic brush or charged particles with the photosensitive member (brush images) may appear. In such a case, it is necessary to make higher the relative speed between the charging unit and the photosensitive member to make them rub against each other in a greater extent so that the charging unit can be brought into uniform contact with the electrophotographic photosensitive member. However, because of such rubbing, the surface of the photosensitive member may abrade or wear, though slightly. Although such wear is at a small level, even microscopic abrasion may have a great influence when it lasts over a long period time, because the a-Si photosensitive member has a long lifetime originally. Accordingly, it is a subject how the contact performance be improved while the abrasion level of the photosensitive member surface is reduced.

As another problem other than such uneven charging, there is also a problem that the contact charging units deteriorate. For example, in the case of a magnetic-brush type contact charging assembly, its magnetic particles may migrate to the electrophotographic photosensitive member side, which is a problem of what is called magnetic-particle leakage. Once the contact charging unit has deteriorated in this way, faulty charging may occur or image deterioration may occur. Hence, this provides a subject on how the contact charging units be made to have long lifetime.

In the case of the image-forming apparatus having cleanerless construction, there is also a subject how the transfer residual toner be collected in the developing assembly. Because of such transfer residual toner, image fog inevitably tends to occur greatly, compared with conventional image-forming apparatus having a cleaner. Accordingly, it has been sought to make more improvement.

The problem of image fog in this cleanerless image-forming apparatus tends to become severer as copying process becomes higher. Accordingly, it has been sought to provide an image-forming apparatus that can meet the demand for higher speed in recent years.

With regard to the polymerization toner, although it has so good a transfer efficiency as to send forth less transfer residual toner, it is difficult for the transfer residual toner on the photosensitive member to be well removed from the photosensitive member surface by the aid of a cleaning blade. Hence, the transfer residual toner may remain on the photosensitive member surface even after cleaning. This is because, the toner has so a uniform particle surface shape that it has a high rolling action mutually between the cleaning blade, the photosensitive member and the toner, so that the toner is not well scraped off by the cleaning blade. It is true that the transfer residual toner can well be removed to a certain extent by bringing the cleaning blade into touch with the photosensitive member surface at a higher pressure to strengthen the action of mechanical scraping. In such a case, however, there have been problems that the photosensitive member is worn by the cleaning blade or the blade turns over. Also, the toner may melt-adhere to the photosensitive member surface or may cause filming thereon to cause a problem that it is difficult to make the photosensitive member have a higher running performance and form images at a higher process speed.

Many proposals are also made on the improvement of photosensitive members themselves. As a patent application concerning an a-Si photosensitive member having a surface layer formed of a non-single-crystal carbon film, Japanese Patent Application Laid-open No. 11-184121 is accessible.

SUMMARY OF THE INVENTION

An object of the present invention is to provide an image-forming apparatus and an image-forming method which have overcome the above problems.

Stated more specifically, an object of the present invention is to provide an image-forming apparatus and an image-forming method which are able to obtain high-quality images free of any unfocused images and smeared images in every environment, without causing any generation of ozone products due to corona discharging.

Another object of the present invention is to provide an image-forming apparatus and an image-forming method in which the a-Si photosensitive member can uniformly be charged to obtain uniform images free of any uneven images and also free of any brush images or coarse images in halftone images.

Still another object of the present invention is to provide an image-forming apparatus and an image-forming method in which the a-Si photosensitive member does not wear and operates stably over a long period of time.

A further object of the present invention is to provide an image-forming apparatus and an image-forming method in which the contact charging unit has a long lifetime and images can stably be obtained at a minimum maintenance cost and over a long period of time.

A still further object of the present invention is to provide an image-forming apparatus and an image-forming method which promise a high image quality and in which, even when the polymerization toner is used, good cleaning performance can be maintained, without causing difficulties such as melt adhesion, filming and also wear of photosensitive members.

The present inventors have made extensive studies on the achievement of higher image quality in image-forming apparatus making use of a-Si photosensitive members. As the result, they have reached a conclusion that it is effective to use a contact charging type charging assembly in order to be free of the smeared images and uneven charging that are questioned when the a-Si photosensitive member is charged by means of a corona charging assembly, and also to use a polymerization toner in combination in order to form sharp images in a high resolution.

That is, the present invention provides an image-forming apparatus comprising:

- an electrophotographic photosensitive member having a conductive substrate, and at least a photoconductive layer and a surface layer on the conductive substrate;
- a charging means for charging the electrophotographic photosensitive member electrostatically;
- a latent-image-forming means for performing imagewise exposure to form an electrostatic latent image on the electrophotographic photosensitive member;
- a developing means for moving a toner to the electrostatic latent image formed on the electrophotographic photosensitive member, to render the electrostatic latent image visible to form a toner image; and
- a transfer means for transferring the toner image to a transfer medium;

wherein;

the photoconductive layer of the electrophotographic photosensitive member comprises a non-single-crystal material composed chiefly of silicon;

the surface layer of the electrophotographic photosensitive member comprises a non-single-crystal carbon film containing at least hydrogen, and has an arithmetic-mean roughness Ra ranging from 0 nm to 100 nm in an extent of 10 $\mu$m×10 $\mu$m of the surface layer;

the charging means is a magnetic-brush charging assembly for charging the electrophotographic photosensitive member electrostatically upon application of a voltage, bringing a magnetic brush formed by binding magnetic particles magnetically into contact with the surface of the electrophotographic photosensitive member; and the toner is a magnetic toner having toner particles containing at least a binder resin and a magnetic material, and an inorganic fine powder, and having an average circularity of from 0.950 to 1.000;

the toner having a saturation magnetization of from 10 to 50 $Am^2/kg$ (emu/g) under application of a magnetic field of 79.6 kA/m (1,000 oersteds).

The present invention also provides an image-forming method comprising:

a charging step of electrostatically charging an electrophotographic photosensitive member having a conductive substrate, and at least a photoconductive layer and a surface layer on the conductive substrate;

a latent-image-forming step of performing imagewise exposure to form an electrostatic latent image on the electrophotographic photosensitive member;

a developing step of moving a toner to the electrostatic latent image formed on the electrophotographic photosensitive member, to render the electrostatic latent image visible to form a toner image; and a transfer step of transferring the toner image to a transfer medium;

wherein;

the photoconductive layer of the electrophotographic photosensitive member comprises a non-single-crystal material composed chiefly of silicon;

the surface layer of the electrophotographic photosensitive member comprises a non-single-crystal carbon film containing at least hydrogen, and has an arithmetic-mean roughness Ra ranging from 0 nm to 100 nm in an extent of 10 $\mu$m×10 $\mu$m of the surface layer;

the charging step is a charging step making use of a magnetic-brush charging assembly for charging the electrophotographic photosensitive member electrostatically upon application of a voltage, bringing a magnetic brush formed by binding magnetic particles magnetically into contact with the surface of the electrophotographic photosensitive member; and the toner is a magnetic toner having toner particles containing at least a binder resin and a magnetic material, and an inorganic fine powder, and having an average circularity of from 0.950 to 1.000;

the toner having a saturation magnetization of from 10 to 50 $Am^2/kg$ (emu/g) under application of a magnetic field of 79.6 kA/m (1,000 oersteds).

The present invention still also provides an image-forming apparatus comprising:

an electrophotographic photosensitive member having at least a conductive substrate, and a photoconductive layer and a surface layer which are superposingly formed on the conductive substrate;

a charging means for charging the electrophotographic photosensitive member electrostatically;

a latent-image-forming means for performing imagewise exposure to form an electrostatic latent image on the electrophotographic photosensitive member;

a developing means for rendering the electrostatic latent image visible by the use of a toner to form a toner image; and a transfer means for transferring the toner image to a transfer medium;

wherein;

the photoconductive layer of the electrophotographic photosensitive member comprises a non-single-crystal material composed chiefly of silicon;

the surface layer of the electrophotographic photosensitive member comprises a non-single-crystal carbon film containing at least hydrogen, and has an arithmetic-mean roughness Ra ranging from 0 nm to 100 nm in an extent of 10 $\mu$m×10 $\mu$m of the surface layer;

the charging means has a conductive fine powder and a charging member holding the conductive fine powder on its surface; the conductive fine powder forming the part of contact with the electrophotographic photosensitive member; and is a charging means for charging the electrophotographic photosensitive member electrostatically upon application of a voltage to the charging member; and the toner is a magnetic toner having toner particles containing at least a binder resin and a magnetic material, and an inorganic fine powder, and having an average circularity of from 0.950 to 1.000;

the toner having a saturation magnetization of from 10 to 50 $Am^2/kg$ (emu/g) under application of a magnetic field of 79.6 kA/m (1,000 oersteds).

The present invention further provides an image-forming method comprising:

a charging step of electrostatically charging an electrophotographic photosensitive member having a conductive substrate, and at least a photoconductive layer and a surface layer on the conductive substrate;

a latent-image-forming step of performing imagewise exposure to form an electrostatic latent image on the electrophotographic photosensitive member; a developing step of rendering the electrostatic latent image visible by the use of a toner to form a toner image; and a transfer step of transferring the toner image to a transfer medium;

wherein;

the photoconductive layer of the electrophotographic photosensitive member comprises a non-single-crystal material composed chiefly of silicon;

the surface layer of the electrophotographic photosensitive member comprises a non-single-crystal carbon film containing at least hydrogen, and has an arithmetic-mean roughness Ra ranging from 0 nm to 100 nm in an extent of 10 $\mu$m×10 $\mu$m of the surface layer;

the charging step is a charging step of applying a voltage to a charging member to charge the electrophotographic photosensitive member electrostatically by means of a charging member holding a conductive fine powder on its surface; the conductive fine powder forming the part of contact with the electrophotographic photosensitive member; and the toner is a magnetic toner having toner particles containing at least a binder resin and a magnetic material, and an inorganic fine powder, and having an average circularity of from 0.950 to 1.000;

the toner having a saturation magnetization of from 10 to 50 $Am^2/kg$ (emu/g) under application of a magnetic field of 79.6 kA/m (1,000 oersteds).

DESCRIPTION OF THE PREFERRED EMBODIMENTS

Figure 1:
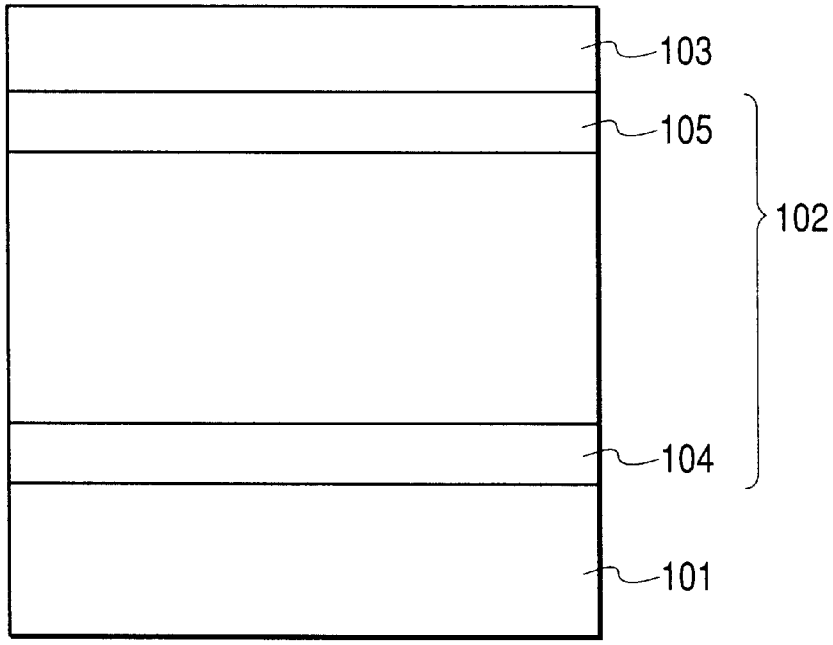
FIG. 1 is a diagrammatic sectional illustration of an example of an electrophotographic photosensitive member used in the image-forming apparatus of the present invention.

Smeared images occurring in an environment of high temperature and high humidity, which are seen in the image-forming apparatus making use of a-Si photosensitive members, are caused by ozone products generated from corona charging assemblies. Corona discharge does not take place as long as a contact charging assembly is used because it enables application of voltage at a level lowered to about charging potential. Hence, such smeared images can be made less occur.

Since, however, in the contact charging unit the marks of contact of the magnetic brush or charged particles with the photosensitive member, called brush images, may appear on images, the contact charging unit and the a-Si photosensitive member must be rubbed against each other at their relative speed made fairly higher. In such a case, in spite of the a-Si photosensitive member, having a high hardness, the photosensitive member surface may abrade when used over a long period of time.

To cope with these problems, extensive studies have been made on how the a-Si photosensitive member be made optimum. As the result, it has been found effective to use a non-single-crystal film containing at least hydrogen and composed chiefly of silicon, i.e., what is called hydrogenated amorphous carbon film (hereinafter "a-C:H" film). It has been ascertained that a-C:H films have a much higher hardness than those formed of any conventional materials, and hence can achieve a sufficiently long lifetime even when rubbed with a contact charging assembly. As a result of further examination of surface shape on its correlation with abrasion level, it has been ascertained that the wear resistance is more improved as the surface has a smaller roughness. Stated more specifically, it has been ascertained that a wear resistance sufficient for practical use can be attained when the surface layer has an arithmetic-mean roughness Ra of 100 nm or smaller.

The present invention has been accomplished on the basis of the above findings.

It is effective for the electrophotographic photosensitive member used in the present invention to have a conductive substrate, and at least a photoconductive layer and a surface layer on the conductive substrate, and to use as the surface layer the non-single-crystal carbon film containing at least hydrogen, what is called hydrogenated amorphous carbon (hereinafter "a-C:H film), as stated above. Since the a-C:H film has much higher hardness than films formed of any conventional materials, it can achieve a sufficiently long lifetime even when rubbed with the contact charging assembly.

As also stated above, as a result of further examination of surface shape on its correlation with abrasion level, it has been ascertained that the wear resistance is more improved as the surface has a smaller roughness. Stated more specifically, it has been ascertained that a wear resistance sufficient for practical use can be attained when the surface layer has an arithmetic-mean roughness Ra of 100 nm or smaller.

There is seen another advantage that the a-C:H film can improve surface lubricity. More specifically, it has been ascertained that, in the case when a magnetic-brush charging assembly is used as the contact charging assembly, the improvement in lubricity of the photosensitive member surface enables magnetic particles to less leak to also bring about the effect of making the contact charging assembly less deteriorate.

Meanwhile, in the case when a spherical toner, in particular, a polymerization toner is used, the toner has spherical particle shape and tends to roll, and also has a uniform particle surface shape, and hence it has a high rolling action mutually between the cleaning blade, the photosensitive member and the toner, so that the toner is not well scraped off by the cleaning blade in some cases, and the transfer residual toner may remain on the photosensitive member surface even after cleaning to cause faulty cleaning. As a result of extensive studies to cope with this problem, it has been ascertained that the state of contact of the cleaning blade with the photosensitive member is greatly concerned. More specifically, where even a slight gap is left between the a-Si photosensitive member and the cleaning blade, the polymerization toner, which originally has spherical particle shape and tends to roll, may enter it like rollers to cause the faulty cleaning consequently.

Accordingly, it is effective for the photosensitive member surface to have the arithmetic-mean roughness Ra of 100 nm or smaller to provide the surface with less unevenness so that it can be in more close contact with the cleaning blade. However, such more close contact of the cleaning blade with the photosensitive member gives a great frictional force, so that the cleaning blade may chatter as the process speed is set higher. Once such chattering of the cleaning blade has occurred, the toner may slip away to cause faulty cleaning as a matter of course, and also the toner may strongly be pressed by the blade against the photosensitive member to cause melt adhesion or filming.

On the problems of the surface shape of the photosensitive member and the chattering of the cleaning blade, too, it is very effective to use the a-C:H film as the surface layer to make the photosensitive member surface have a higher lubricity. More specifically, the a-C:H film is used to provide a very flat surface having the arithmetic-mean roughness Ra of 100 nm or smaller, whereby even under conditions of a higher blade pressure than ever the chattering does not occur at all, bringing about an improvement in cleaning performance even in the case of spherical toners such as the polymerization toner.

Meanwhile, in order to make copying machines compact, and make them free of waste toner to improve toner utilization efficiency, the present inventors have made studies also on the problem of image fog in the image-forming apparatus constructed to have no cleaner. As the result, the spherical toners such as the polymerization toner have proved to be suited in the cleanerless system. This is presumed to be due to the fact that, the polymerization toner has properties of being charged in the state where electric charges are uniformly distributed over particle surfaces and also has spherical particle shape, and hence both the mirror image force to photosensitive member and the van der Waals force are small. As the result, it may less adhere to the photosensitive member to produce less transfer residual toner, and at the same time can more effectively be collected in the developing assembly. Thus, the cleanerless or cleaning-at-development process can be carried out with ease.

However, even in using the polymerization toner, it has been sought to make further improvement with regard to image fog under high-speed process conditions. Accordingly, further studies have been made on the surface of electrophotographic photosensitive member that can be optimum for the polymerization toner. As the result, it has been ascertained that the image fog can be made fairly less occur by making the surface of the photosensitive member the a-C:H film. This is presumed to be concerned with the fact that the material a-C:H has a low surface free energy and a high repellency. However, even in using such an a-C:H surface layer, with regard to the image fog, there has still been room for improvement.

The present inventors have made further studies on surface properties. As the result, it has been ascertained that, the photosensitive member surface may be regulated to a surface with a small unevenness to have the arithmetic-mean roughness Ra of 100 nm or smaller, whereby the image fog can be made dramatically less occur. Details on this are unclear at present, and are presumed to be that the photosensitive member surface having been made to have less unevenness has much smaller area of contact with the polymerization toner to bring about an improvement in toner collection performance in the developing assembly.

As stated above, the present invention has made it possible for the first time to provide an image-forming apparatus which is not influenced by environment and promises high image quality and long lifetime by virtue of combination of three factors, the magnetic brush charging apparatus as the contact charging unit, the polymerization toner and the a-Si photosensitive member having the surface layer formed of a-C:H.

The present invention is specifically described below with reference to the drawings.

(1) Electrophotographic photosensitive member in the present invention:

First, embodiments of the electrophotographic photosensitive member used in the image-forming apparatus and image-forming method of the present invention are described below with reference to the drawings.

FIG. 1 is a diagrammatic view for describing an embodiment of the electrophotographic photosensitive member used in the image-forming method of the present invention.

Shown here is an electrophotographic photosensitive member comprising a conductive substrate 101 made of a conductive material as exemplified by aluminum or stainless steel, a photoconductive layer 102 provided on this conductive substrate, and a surface layer 103 as an outermost layer, which are superposed in order.

In the present invention, the photoconductive layer 102 contains at least hydrogen and/or a halogen and is formed of a non-single-crystal material (a-Si) composed chiefly of silicon. As the surface layer 103, a non-single-crystal carbon film (a-C:H film) is used.

The photoconductive layer 102 may further optionally be provided, between its interface with the surface layer 103, with a buffer layer 105 formed of, e.g., amorphous silicon carbide, amorphous silicon nitride or amorphous silicon oxide.

Between the photoconductive layer 102 and the conductive substrate 101, a lower-part blocking layer 104 may further be provided which blocks the injection of carriers from the conductive substrate 101 and also improves the adherence of the photoconductive layer 102. In the buffer layer 105 and the lower-part blocking layer 104, dopants such as Group 3B elements or group 5B elements may be incorporated under appropriate selection so that the polarity of charging, i.e., positive charging or negative charging can be controlled.

The photoconductive layer 102 in the present invention may also functionally be separated into a charge generation layer and a charge transport layer (both not shown) which are constituted of an amorphous material containing at least silicon atoms to provide a function-separated photosensitive member. In such an electrophotographic photosensitive member, photocarriers are formed chiefly in the charge generation layer upon irradiation by light and pass through the charge transport layer to reach the conductive substrate 101.

The conductive substrate 101 may have any desired shape according to the drive method of the electrophotographic photosensitive member.

(1) Conductive substrate:

The conductive substrate 101 in the present invention may include insulating substrates made of materials such as aluminum, iron, chromium, magnesium, stainless steel and alloys of any of these, as well as glass, quartz, ceramics and heat-resistant synthetic resin films the surfaces of which have been conductive-treated at least on their side on which the photoconductive layer is to be formed. It is also preferable for these surfaces to be subjected to mirror-finishing by means of a lathe. The conductive substrate may have any shape including the shape of a roller and the shape of an endless belt.

(2) Surface layer:

The surface layer 103 in the present invention comprises a non-single-crystal carbon film containing at least hydrogen. The "non-single-crystal carbon" herein referred to is chiefly meant to be amorphous carbon having properties intermediate between graphite and diamond, and may be microcrystalline or polycrystalline in part. This surface layer 103 has a free surface, and is provided chiefly for the purpose of achieving the object of the present invention, i.e., for preventing wear, scratching and melt adhesion in its use over a long period of time, and improving cleaning performance.

The surface layer 103 in the present invention can be formed by plasma-assisted CVD, sputtering, ion plating or the like in which hydrocarbons which are gaseous at normal temperature and normal pressure are used as material gases. Films formed by a plasma-assisted CVD process described later are preferable for their use as surface layers because they are high in both transparency and hardness. Also, as discharge frequency used in plasma-assisted CVD when the surface layer 103 according to the present invention is formed, any frequency may be used. Preferably, a frequency of 1 to 450 MHz may be used. In an industrial scale, preferably usable are a high frequency of from 1 MHz or higher to lower than 450 MHz, and typically 13.56 MHz, called an RF frequency band, and a high frequency of from 50 MHz or higher to 450 MHz or lower, and typically 105 MHz, called a VHF frequency band.

Materials that can serve as material gases for feeding carbon may include gaseous or gasifiable hydrocarbons such as $CH_4$, $C_2H_6$, $C_3H_8$ and $C_4H_{10}$. In view of readiness in handling for layer formation and carbon-feeding efficiency, the material may preferably include $CH_4$ and $C_2H_6$. Also, these carbon-feeding material gases may be used optionally after their dilution with a gas such as $H_2$, He, Ar or Ne.

The arithmetic-mean roughness Ra in an extent of 10 $\mu$m×10 $\mu$m of the surface layer is in the range of from 0 nm to 100 nm, and more preferably in the range of from 5 nm to 80 nm. If the surface layer 103 has an arithmetic-mean roughness Ra greater than 100 nm, the surface layer may have no smoothness, and can not exhibit any sufficient wear resistance in some cases.

As a method of controlling the arithmetic-mean roughness Ra, it can be controlled by causing plasma discharge to take place using fluorine-containing gas, hydrogen gas or oxygen gas to etch the surface layer 103. As conditions for such plasma discharging, optimum conditions may differ for each type of apparatus, and can not sweepingly be prescribed. In general, the plasma discharging may be carried out changing the high-frequency power for exciting the plasma, changing the type of etching gas, controlling the conductive substrate temperature, and appropriately regulating the degree at which bias power is applied to the conductive substrate. As other method, the arithmetic-mean roughness Ra may also be controlled by polishing the surface by means of an a-Si photosensitive member surface-polishing apparatus described later.

The arithmetic-mean roughness Ra in an extent of 10 $\mu$m×10 $\mu$m of the surface layer as referred to in the present invention is the value obtained by three-dimentionally extending the arithmetic-mean roughness Ra defined in JIS B0601. It may be expressed as "the value obtained by averaging the absolute value of any deviation from a standard surface to a specified surface", and is given by the following equations.

Where the shape of the surface the arithmetic-mean roughness of which is to be determined is represented by the following equation (I):

$$Z=f(x,y)$$

and the standard surface $Z_0$ is represented by the following equation (II):

$$Z_0 = \frac{1}{L^2}\int_0^L\int_0^L f(x, y)dxdy,$$

the arithmetic-mean roughness Ra is given by the following equation (III):

$$R_a = \frac{1}{L^2}\int_0^L\int_0^L \left| f(x, y) - Z_0 \right| dxdy.$$

Here, L is the length of one side of the region to be measured. In the present invention, L is 10 $\mu$m. Also, the value of Ra is expressed by nanometer (nm)

In the present invention, as a specific manner for measuring the arithmetic-mean roughness Ra, an atomic-force microscope (AFM) Q-Scope 250, Version 3, 181, manufactured by Quesant Co., may be used. The value is used which is calculated from the three-dimensional shape measured setting the extent of visual field to be 10 $\mu$m×10 $\mu$m.

Incidentally, for the arithmetic-mean roughness Ra defined in JIS B0601 and the arithmetic-mean roughness Ra in an extent of 10 $\mu$m×10 $\mu$m in the present invention, substantially the same result is obtained in respect of value. However, the latter arithmetic-mean roughness Ra in an extent of 10 $\mu$m×10 $\mu$m has a merit that it can provide stabler results.

The surface layer 103 comprised of a-C:H in the present invention can attain the like effect even when some impurities are contained. For example, even when impurities such as Si, N, O, P and/or B are contained in the surface layer 103, the effect of the present invention can be attained as long as they are in a content not more than 10% based on that of the total elements.

The surface layer 103 according to the present invention is incorporated with hydrogen atoms. The incorporation of hydrogen atoms effectively compensates any structural defects present in the film to reduce its localized-state level density. Hence, the film is improved in transparency, and the surface layer can be kept therein from any unwanted unnecessary absorption of light, bringing about an improvement in photosensitivity. Also, the presence of hydrogen atoms in the film is said to play an important role for solid lubricity.

The hydrogen atoms incorporated in the the surface layer 103 film comprised of a-C:H may preferably be in a content of from 41 to 60 atomic %, and more preferably from 45 to 50 atomic %, as H/(C+H). If the hydrogen content is less than 41 atomic %, the surface layer may have a narrow optical band gap to become unsuitable in view of sensitivity. If on the other hand it is more than 60 atomic %, the surface layer may have a low hardness to tend to cause abrasion.

In the present invention, as a method of measuring the content of hydrogen atoms incorporated in the surface layer of the photosensitive member, it may include the following method.

On a silicon wafer mirror-polished when the surface layer is formed, a film is deposited in a thickness of 1 $\mu$m under the same production conditions as those at the time of film formation to prepare a sample. Infrared absorption spectra of this sample are measured with an infrared spectrophotometer. In the case when the hydrogen content is measured, the hydrogen content in the film can be determined from the area of C-Hn absorption peak appearing at 2,920 $cm^{-1}$ vicinity and the layer thickness.

The amount of hydrogen atoms incorporated in the surface layer may be controlled by controlling, e.g., the temperature of conductive substrate when the photosensitive member is produced, the amount of feed materials used to incorporate hydrogen atoms which are fed into a reactor, and the discharging electric power.

Optical band gaps of the surface layer may commonly be at a value of from 1.2 to 2.2 eV ($1.92\times10^{-19}$ to $3.5\times10^{-19}$ J), which may be preferable, and may more preferably be 1.6 eV ($2.6\times10^{-19}$ J) or more in view of sensitivity.

The surface layer 103 may preferably have a refractive index of from 1.6 to 2.8.

The surface layer may have a layer thickness of from 5 to 1,000 nm, and preferably from 10 to 200 nm. If it has a thickness smaller than 5 nm, its mechanical strength may come into question. If it has a thickness larger than 1,000 nm, a problem tends to occur in respect of photosensitivity. The layer thickness of the surface layer 103 can be measured with an interference layer thickness meter. Whether or not the surface layer has been formed in the desired layer thickness can be confirmed by such measurement.

Halogen atoms may optionally be incorporated in the surface layer 103 in the present invention. Materials that can serve as material gases for feeding halogen atoms may include, e.g., $F_2$ and interhalogen compounds such as BrF, ClF, $ClF_3$, $BrF_3$, $BrF_5$, $IF_3$ and $IF_7$. Fluorine-containing gases such as $CF_4$, $CHF_3$, $C_2F_6$, $ClF_3$, $CHClF_2$. $C_3F_8$ and $C_4F_{10}$ may further preferably be used.

In the present invention, atoms capable of controlling the conductivity may further optionally be incorporated in the surface layer 103. The atoms capable of controlling the conductivity, incorporated in the surface layer 103, may include what is called impurities, used in the field of semiconductors. Usable are atoms belonging to Group 3B of the periodic table, capable of imparting p-type conductivity, or atoms belonging to Group 5B of the periodic table, capable of imparting n-type conductivity. The atoms capable of controlling the conductivity, incorporated in the surface layer 103 in the present invention, may preferably be in an amount of from 10 to $1\times10^4$ atomic ppm, more preferably from 50 to $5\times10^3$ atomic ppm, and most preferably from $1\times10^2$ to $1\times10^3$ atomic ppm.

The conductive substrate temperature set when the surface layer is deposited may be regulated to from room temperature to 400° C. Any too high substrate temperature may lower band gaps to lower transparency, and hence the temperature may preferably be set on the lower side.

With regard to high-frequency power, it may preferably be as high as possible because the decomposition of material gases proceeds sufficiently. Stated specifically, it may preferably be 5 W or higher per 1 ml/min (normal) of materials gas. Any too high power may cause abnormal discharge to cause deterioration of characteristics of the electrophotographic photosensitive member, and hence it must be controlled to a power suitable enough not to cause the abnormal discharge. With regard to the pressure of discharge space, it may be kept at 13.3 to 1,330 Pa when a usual RF power (typically 13.56 MHz) is used, and at 13.3 mPa to 1,330 Pa when a VHF power (typically 50 to 450 MHz) is used. It may preferably be a pressure as low as possible.

(2) Photoconductive layer:

The photoconductive layer 102 of the photosensitive member in the present invention comprises a non-single-crystal material composed chiefly of silicon, and may preferably contain at least hydrogen and/or a halogen.

The "non-single-crystal material composed chiefly of silicon" herein referred to is chiefly meant to be amorphous silicon, and may be microcrystalline or polycrystalline in part.

The photoconductive layer 102 in the present invention may preferably be any non-single-crystal material composed chiefly of silicon, i.e., what is called an a-Si film.

The a-Si film can be formed by plasma-assisted CVD, sputtering or ion plating. The film formed by plasma-assisted CVD is preferred because a film having an especially high quality can thereby be obtained. As an excitation source for the plasma-assisted CVD, glow discharge plasma produced by high-frequency power, VHF-power or microwaves having any frequency may preferably be used. A material gas containing silicon atoms is decomposed by this glow discharge plasma to form the film.

As the material gas, a gaseous or gasifiable silicon hydride (silane) such as $SiH_4$, $Si_2H_6$, $Si_3H_8$ or $Si_4H_{10}$ may be used, which may be decomposed using a high-frequency power to form the film.

When the photoconductive layer is deposited, the conductive substrate may preferably be kept at a temperature of about 150 to 450° C. in view of the film characteristics. This is to accelerate surface reaction on the substrate surface to relax its structure sufficiently. Also, the above gas may further be mixed with $H_2$ or a halogen-containing gas in a desired quantity to form the layer. This is preferable in order to improve the characteristics.

Materials that can be effective as material gases for feeding halogen atoms may include fluorine gas ($F_2$) and interhalogen compounds such as BrF, ClF, $ClF_3$, $BrF_3$, $BrF_5$, $IF_3$ and $IF_7$.

A silicon compound containing a halogen atom, as exemplified by a silane derivative substituted with a halogen atom may also be used as the material. Such a silane derivative may include silicon fluorides such as $SiF_4$ and $Si_2F_6$ as preferred examples. Also, these halogen-feeding material gases may be used optionally after their dilution with a gas such as $H_2$, He, Ar or Ne.

There are no particular limitations on the layer thickness of the photoconductive layer. It may appropriately be determined in the range of from 1 to 100 $\mu$m in accordance with the chargeability and sensitivity required by the image-forming apparatus itself. In usual cases, it may preferably be 10 $\mu$m or more in view of chargeability and sensitivity, and 50 $\mu$m or less from the viewpoint of industrial productivity.

The photoconductive layer may also be formed in multilayer construction in order to improve characteristics. For example, a layer having narrower band gaps may be disposed on the surface side, and a layer having broader band gaps on the substrate side. This enables simultaneous improvement of photosensitivity and charging performance. In particular, the designing of such layer construction can bring out a striking effect on light sources having a relatively long wavelength and also little scattering of wavelength as in semiconductor lasers.

As discharge frequency used in plasma-assisted CVD when the photoconductive layer in the present invention is formed, any frequency may be used. In an industrial scale, preferably usable are a high frequency of from 1 MHz to 50 MHz, called an RF frequency band, and a high frequency of from 50 MHz to 450 MHz, called a VHF frequency band.

The photoconductive layer described above may also be so constructed as to be functionally separated into two layers, a charge generation layer and a charge transport layer, as described previously.

(3) Buffer layer:

The electrophotographic photosensitive member in the present invention may also have a form in which a buffer layer is provided between the surface layer 103 and the photoconductive layer 102.

The buffer layer 105 comprises a non-single-crystal material which is basically formed of amorphous silicon composed chiefly of silicon atoms (a-Si(H,X)), containing hydrogen and/or a halogen, and which further contains at least one kind of atoms selected from carbon atoms, nitrogen atoms and oxygen atoms. Such a non-single-crystal material may include amorphous silicon carbide, amorphous silicon nitride and amorphous silicon oxide. It may more preferably be formed of an amorphous silicon carbide having composition intermediate between a-Si and a-C:H, (a-Si:C(H,X)). In this case, the composition of the buffer layer may continuously be changed from the photoconductive layer side toward the surface layer 103 side. This is effective for preventing interference or the like. Also, in the buffer layer 105, dopants such as Group 3B elements or Group 5B elements may be incorporated so that its conductivity type can be controlled and the layer can be made to have an upper-part blocking ability to block the injection of charged carriers from the surface.

Material gases used for the buffer layer in the present invention may preferably include the following.

Materials that can serve as material gases for feeding carbon may include gaseous or gasifiable hydrocarbons such as $CH_4$, $C_2H_6$, $C_3H_8$ and $C_4H_{10}$.

Materials that can serve as material gases for feeding nitrogen or oxygen may include gaseous or gasifiable compounds such as $NH_3$, NO, $N_2O$, $NO_2$,$NO_2$, CO, $CO_2$ and $N_2$.

The buffer layer can be formed by plasma-assisted CVD, sputtering or ion plating. Also, as discharge frequency used in plasma-assisted CVD when the buffer layer in the present invention is formed, any frequency may be used. In an industrial scale, preferably usable are a high frequency of from 1 MHz to 50 MHz, called an RF frequency band, and a high frequency of from 50 MHz to 450 MHz, called a VHF frequency band.

When the buffer layer is deposited, the conductive substrate may preferably be regulated to a temperature of from 50 to 450° C., and more preferably from 100 to 300° C.

As discharge frequency used in plasma-assisted CVD when the buffer layer in the present invention is formed, any frequency may be used. In an industrial scale, preferably usable are a high frequency of from 1 MHz to 50 MHz, called an RF frequency band, and a high frequency of from 50 MHz or higher to 450 MHz, called a VHF frequency band.

(4) Other layer:

In addition to the surface layer, buffer layer and photoconductive layer described above, the photosensitive member of the present invention may also preferably be provided with a lower-part blocking layer 104 between the photoconductive layer and the conductive substrate.

In the case when the lower-part blocking layer 104 is provided, it may commonly be formed of a-Si(H,X) as a base, and may be incorporated with dopants such as Group 3B elements or Group SB elements so that its conductivity type can be controlled and the layer can be made to have the ability to block the injection of carriers from the conductive substrate. In this case, at least one kind of atoms selected from carbon atoms, nitrogen atoms and oxygen atoms may optionally be incorporated to regulate stress, and to make the layer have the function to improve adherence to the photoconductive layer.

(2) Production of electrophotographic photosensitive member in the present invention:

An example for the production of the electrophotographic photosensitive member in the present invention is described below.

Figure 2:
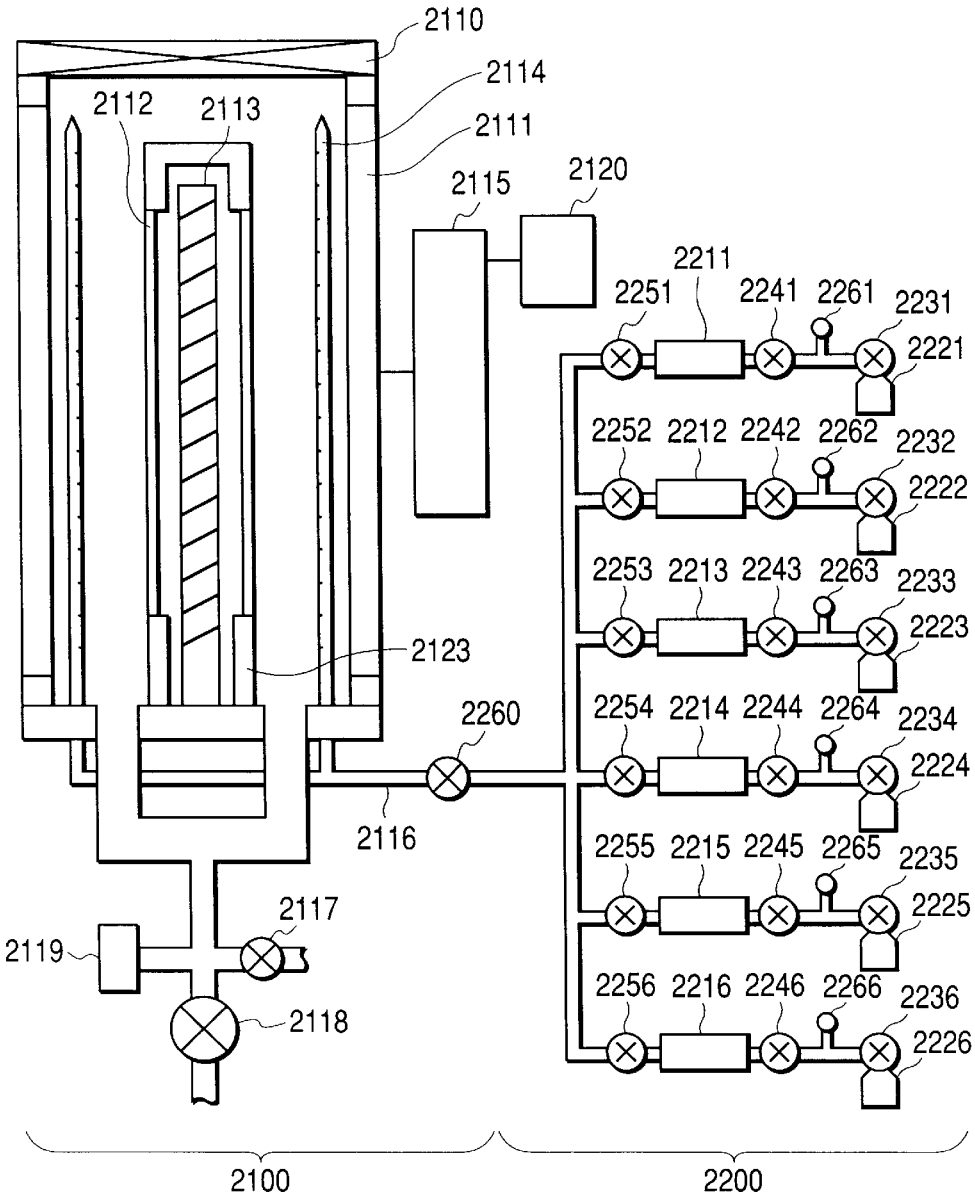
FIG. 2 is a schematic illustration of an example of a deposition system for forming an electrophotographic photosensitive member.

FIG. 2 diagrammatically illustrates an example of a deposition apparatus for producing the photosensitive member by RF plasma-assisted CVD making use of a high-frequency power source.

Stated roughly, this apparatus is chiefly constituted of a deposition system 2100, a material gas feed system 2200 and an exhaust system (not shown) for evacuating the inside of a film-forming reactor 2110.

In the film-forming reactor 2110 in the deposition system 2100, a conductive substrate 2112 as grounded, a heater 2113 for heating the conductive substrate, and a material gas feed pipe 2114 are provided. A high-frequency power 2120 is also connected to the film-forming reactor through a high-frequency matching box 2115.

The material gas feed system 2200 is constituted of gas cylinders 2221 to 2226 for material gases such as $SiH_4$, $H_2$, $CH_4$, NO, $B2H_6$ and $CF_4$, valves 2231 to 2236, 2241 to 2246 and 2251 to 2256, and mass flow controllers 2211 to 2216. The gas cylinders for the respective material gases are connected to a gas feed pipe 2114 in the film-forming reactor 2110 through a valve 2260.

The conductive substrate 2112 is set on a conductive holding stand 2123, and thus connected to a ground.

An example of procedure of a method for forming photosensitive-member deposited films by means of the system shown in FIG. 2 is described below.

The conductive substrate 2112 is set in the film-forming reactor 2110, and the inside of the film-forming reactor 2110 is evacuated by means of an evacuation unit (e.g., a vacuum pump) (not shown). Subsequently, the temperature of the conductive substrate 2112 is controlled at a desired temperature of from 150 to 450° C. by means of the heater 2113 for heating the conductive substrate. Then, before material gases for forming photosensitive-member deposited films are flowed into the film-forming reactor 2110, gas cylinder valves 2231 to 2236 and a leak valve 2117 of the film-forming reactor are checked to make sure that they are closed, and also flow-in valves 2241 to 2246, flow-out valves 2251 to 2256 and an auxiliary valve 2260 are checked to make sure that they are opened. Then, firstly a main valve 2118 is opened to evacuate the insides of the film-forming reactor 2110 and a gas feed pipe 2116.

Thereafter, at the time a vacuum gauge 2119 has been read to indicate a pressure of 0.67 mPa, the auxiliary valve 2260 and the flow-out valves 2251 to 2256 are closed. Thereafter, valves 2231 to 2236 are opened so that gases are respectively introduced from gas cylinders 2221 to 2226, and each gas is controlled to have a pressure of 0.2 MPa by operating pressure controllers 2261 to 2266. Next, the flow-in valves 2241 to 2246 are slowly opened so that gases are respectively introduced into mass flow controllers 2211 to 2216.

After the film formation is thus ready to start, the photoconductive layer is first formed according to the following procedure.

That is, at the time the conductive substrate 2112 has had the desired temperature, some necessary flow-out valves 2251 to 2256 and the auxiliary valve 2260 are slowly opened so that desired gases are fed into the film-forming reactor 2110 from the gas cylinders 2221 to 2226 through a gas feed pipe 2114. Next, the mass flow controllers 2211 to 2216 are operated so that each material gas is regulated to flow at a desired rate. In that course, the opening of the main valve 2118 is so adjusted that the pressure inside the film-forming reactor 2110 comes to be a desired pressure of 13.3 Pa to 1,330 Pa, watching the vacuum gauge 2119. At the time the inner pressure has become stable, the high-frequency power source 2120 is set at the desired electric power, for example, a high-frequency of from 1 to 50 MHz, e.g., 13.56 MHz, and the high-frequency power is supplied to a cathode electrode 2111 through the high-frequency matching box 2115 to cause glow discharge to take place.

The material gases fed into the film-forming reactor 2110 are decomposed by the discharge energy thus produced, so that the desired photoconductive layer composed chiefly of silicon atoms is formed on the conductive substrate 2112. After the layer with a desired thickness has been formed, the supply of high-frequency power is stopped, and the flow-out valves 2251 to 2256 are closed to stop the material gases from flowing into the film-forming reactor 2110. The formation of the photoconductive layer is thus completed. The photoconductive layer may be formed in known composition and layer thickness.

Next, the surface layer is film-formed. The surface layer may be formed according to basically the same procedure for film-forming the photoconductive layer, except that a hydrocarbon gas such as $CH_4$ or $C_2H_6$ is used as the material gas and a dilute gas such as $H_2$ is optionally used. In the film formation of the surface layer, the high-frequency power source 2120 is set at a frequency of, e.g., from 1 to 50 MHz, and typically 13.56 MHz, and the high-frequency power is supplied to the cathode electrode 2111 through the high-frequency matching box 2115 to cause glow discharge to take place. Also, in order to achieve uniform formation of the layer in the course of the layer formation, the conductive substrate 2112 and the conductive holding stand 2123 may optionally be rotated at a desired speed by means of a drive unit (not shown).

Figure 3:
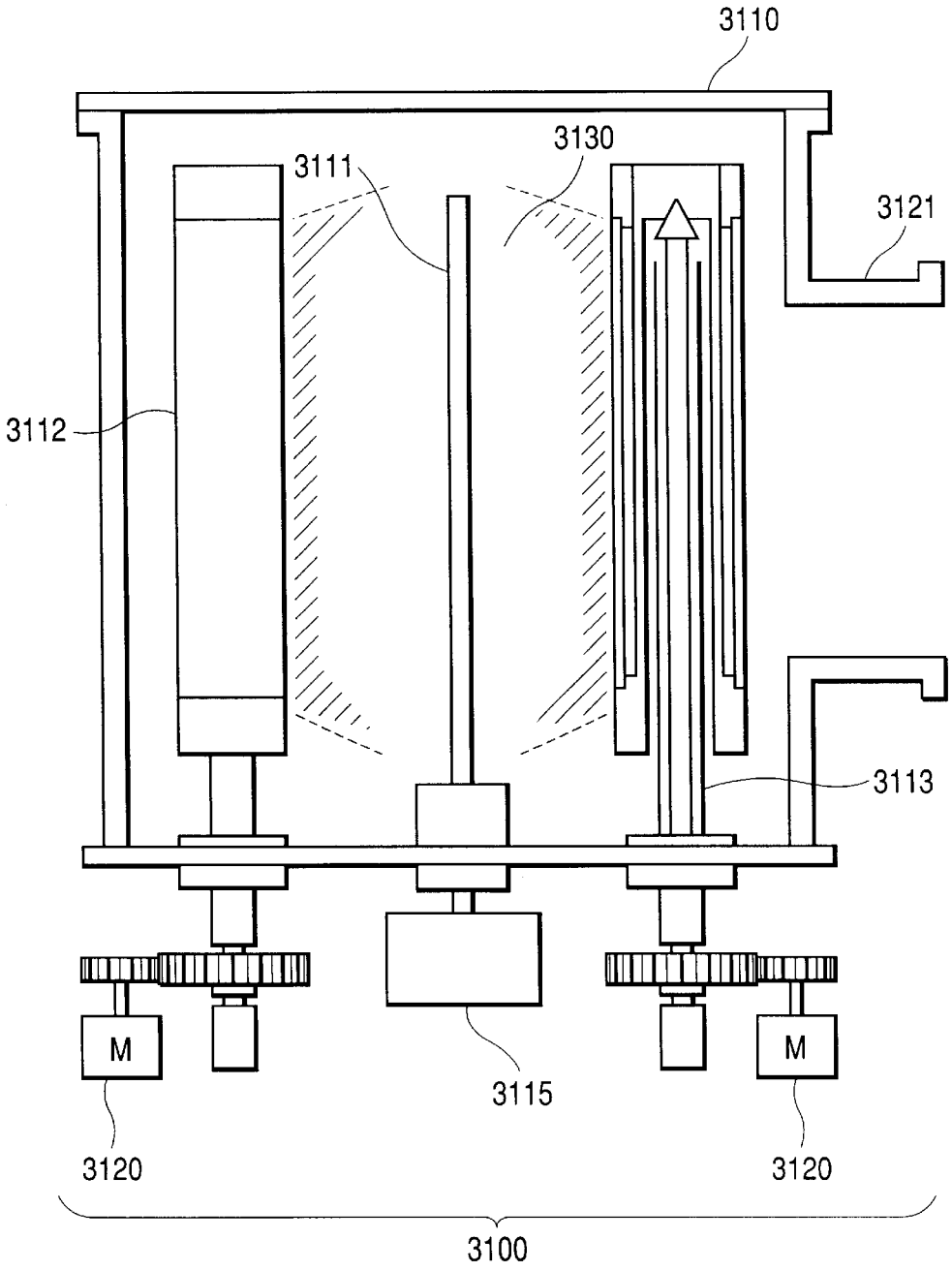
FIG. 3 is a schematic illustration of an example of a deposition system for forming electrophotographic photosensitive members.

FIG. 3 diagrammatically illustrates an example of a deposition apparatus for producing the photosensitive member by VHF plasma-assisted CVD method making use of a VHF power source.

This apparatus is set up by replacing the deposition system 2100 shown in FIG. 2, with a deposition system 3100 shown in FIG. 3.

The formation of deposited films by VHF plasma-assisted CVD method using this apparatus may be carried out basically in the same manner as the case of RF plasma-assisted CVD method, provided that the high-frequency power to be applied is supplied from a VHF power source of 50 to 450 MHz, e.g., 105 MHz, in frequency, and the pressure is set at about 13.3 mPa to 13.3 Pa, which is a little lower than that in the RF plasma-assisted CVD method. First, conductive substrates 3112 are set inside a reactor 3110. Then, the inside of the reactor 3110 is evacuated by means of an evacuation unit not shown (e.g., a diffusion pump) through an exhaust pipe 3132. Subsequently, the conductive substrates 3112 are heated by heaters 3113 for heating the conductive substrates. Then, material gases are fed into the reactor through gas feed pipes (not shown). In a discharge space 3130 surrounded by the conductive substrates 3112, the material gases fed into the reactor are excited and dissociated by glow discharge made to take place by supplying a VHF power to the discharge space 3130 through a matching box 3115, thus the intended deposited films are formed on the conductive substrates 3112. Here, in order to achieve uniform formation of the layers, the conductive substrates 3112 may preferably be rotated at a desired rotational speed by means of motors 3120 for rotating the conductive substrates.

The a-Si photosensitive member in which the film formation has been completed up to the surface layer is subsequently subjected to etching with use of a fluorine-containing gas to regulate the arithmetic-mean roughness Ra to be 100 nm or smaller. When its arithmetic-mean roughness is reduced, it is effective to apply the high-frequency power at a little lower voltage than usual. Also, as a method other than the etching, the photosensitive member surface may be polished by means of a surface-polishing apparatus.

Figure 4:
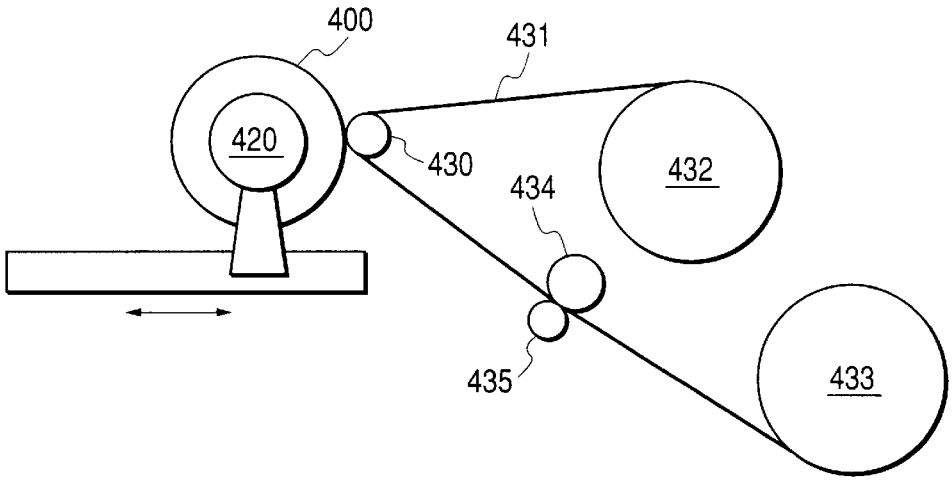
FIG. 4 is a schematic illustration of an a-Si photosensitive member surface-polishing apparatus.

As an a-Si photosensitive member surface-polishing apparatus, an apparatus shown in FIG. 4 is available. It is preferable to polish the surface layer by means of this apparatus to regulate the arithmetic-mean roughness Ra of the surface layer.

In FIG. 4, reference numeral 400 denotes a photosensitive member. Reference numeral 420 denotes an elastic support mechanism, stated specifically, an air pressure holder. For example, an air pressure holder manufactured by Bridgestone Corporation (trade name: AIR PICK; model: PO45TCA*820) may be used. A pressure elastic roller 430 is pressed against the a-Si photosensitive member via a polishing tape 431 delivered from a wind-off roll 432 to a wind-up roll 433 through a constant-rate delivery roll 434 and a capstan roller 435. The polishing tape 431 may preferably be one usually called a lapping tape, in which SiC, $Al_2O_3$, $Fe_2O_3$ or the like is used as abrasive grains. It may include, e.g., a lapping tape LT-C2000, available from Fuji Photo Film Co., Ltd. This tape is used also in Examples given later, to carry out polishing.

The pressure elastic roller 430 is made of a material such as neoprene rubber or silicone rubber, and may preferably be one having a JIS rubber hardness of from 20 to 80, and more preferably a JIS rubber hardness of from 30 to 40. It may also preferably have such a shape that its cylinder has a diameter which is larger at the middle portion than that at both ends, preferably having a diameter difference of from 0 to 0.6 mm, and more preferably from 0.2 to 0.4 mm. The pressure elastic roller 430 is pressed against the photosensitive member 400 being rotated, at a pressure of from 0.5 to 2.0 kg, during which the lapping tape is fed between them to polish the photosensitive member surface.

Thus, the arithmetic-mean roughness Ra of the photosensitive member surface is regulated to a preferable value by the method of etching described previously or by means of the above polishing apparatus. The arithmetic-mean roughness Ra of the photosensitive member surface may be measured and calculated using an AFM (atomic-force microscope), e.g., Q-Scope 250, manufactured by Quesant Co., may be used.

(3) Charging means in the present invention:

As a first embodiment, the charging means in the present invention is a contact charging unit having a magnetic-brush formed by binding magnetic particles magnetically to its support member.

Figure 5:
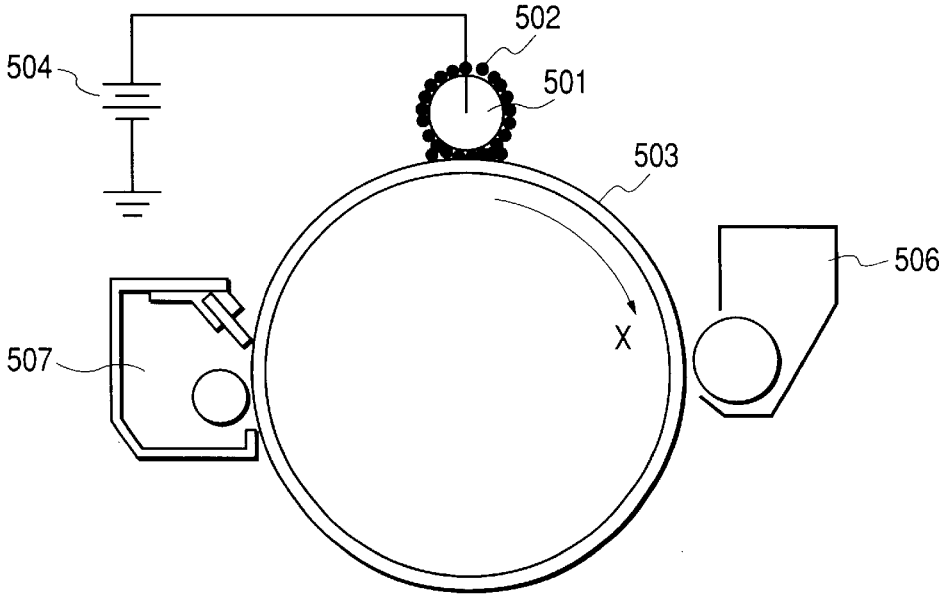
FIG. 5 is a schematic illustration of an example of a contact charging unit used in the image-forming apparatus of the present invention.

FIG. 5 illustrates an example of an image-forming apparatus in which such a magnetic-brush charging assembly is used as the contact charging unit. The magnetic-brush charging assembly has a charging member comprising a mandrel (the support member) 501 made of a magnetic body, and formed on its periphery a magnetic-brush layer 502 constituted of magnetic particles. The mandrel 501 is connected with a voltage application means 504, and the magnetic-brush layer 502 is kept in contact with the surface of the electrophotographic photosensitive member to perform charging. Reference numeral 506 denotes a developing assembly; and 507, a cleaner.

As the mandrel 501, a ferrite magnet or a magnetic body capable of providing multi-polar construction of a plastic magnet may be used.

To the mandrel 501, the voltage application means 504 is connected, and a direct-current voltage (Vdc) or a voltage formed by superimposing an alternating-current voltage to a direct-current voltage (Vdc+Vac) is applied to the magnetic particles of the magnetic brush 502 via the mandrel 501. Thus, electric charges are directly injected through the part of contact with the surface of the photosensitive member 503, and the photosensitive member is uniformly charged.

The magnetic-brush charging member is rotated and moved at an appropriate relative speed with respect to the rotational direction X of he photosensitive member 503. It may also be kept vibrated. As an index to show the difference in relative speed, a relative movement speed ratio represented by the following equation (IV) is available.

Equation (IV)

Relative movement speed ratio (%)=

$$|(Vc-Vp)/Vp|\times 100$$

(In the equation, Vc is the movement speed of the charging member surface, Vp is the movement speed of the photosensitive member surface, and the Vc is the value to be represented by the same letter symbol as Vp when the charging member surface moves in the same direction as the photosensitive member surface at their contact zone).

The relative movement speed ratio may usually be from 10 to 500%.

The magnetic particles may preferably have a volume-average particle diameter of from 10 to 50 $\mu$m, and more preferably from 15 to 30 $\mu$m. If the particles are smaller than 10 $\mu$m, the magnetic brush tends to adhere to the photosensitive member, and also the magnetic particles may have a poor transport performance when made into the magnetic brush. If the particles are larger than 50 $\mu$m, the magnetic particles and the photosensitive member may have less contact points to tend to deteriorate the charging uniformity of injection charging.

In the present invention, the volume-average particle diameter and particle size distribution of the magnetic particles are measured using a laser diffraction particle size distribution measuring instrument HELOS (manufactured by Nippon Denshi K. K.) and a dry dispersion unit RODOS (manufactured by Nippon Denshi K. K.) in combination, under conditions of a lens focal length of 200 mm, a dispersion pressure of 3.0 Bar and a measurement time of 1 to 2 seconds, dividing the range of particle diameters of 0.5 $\mu$m to 350 $\mu$m into 31 channels. The 50% particle diameter (median diameter) of volume distribution is determined as volume-average particle diameter and also the percent (%) by volume of particles in each particle diameter range can be determined from volume-based frequency distribution. In the present invention, the laser diffraction particle size distribution measuring instrument HELOS is an instrument which makes measurement by the principle of Fraunhofer diffraction. To explain this measurement principle, a laser beam is applied to measuring particles from a laser beam source, whereupon a diffraction image is formed on the focal plain of a lens placed on the opposite side of the laser beam source. This diffraction image is detected with a detector, followed by arithmetic processing to calculate the particle size distribution of the measuring particles.

The magnetic particles used in the present invention may preferably have a volume resistivity of from $1\times10^4$ to $1\times10^9$ Ω•cm. If the volume resistivity is lower than $1\times10^4$ Ω•cm, pinhole leak tends to occur. If is is higher than $1\times10^9$ Ω•cm, the photosensitive member tends to be insufficiently charged. In the sense of magnetic-particle leakage, the magnetic particles for charging may more preferably have a volume resistivity of $1\times10^5$ Ω•cm or higher. Further, as resistance distribution preferable in the present invention, the magnetic particles may have a small difference in resistivity between particles having a relatively small particle diameter and particles having a relatively small particle diameter.

In the present invention, the volume resistivity of the magnetic particles is measured in the following way.

An insulating cell is filled with magnetic particles, and opposing electrodes are provided in contact with the magnetic particles, where a voltage is applied cross the electrodes, and the electric current flowing there is measured. Measuring conditions are as follows: In an environment of 23° C./65% RH, the magnetic particles and the electrodes are kept in contact in a contact area of 2 $cm^2$ and in a thickness of 1 mm, under application of a load of 10 kg to the upper electrode and at an applied voltage of 100 V.

As the magnetic particles in the present invention, various materials of single or mixed crystals of conductive metals such as ferrite and magnetite may be used. Besides, the magnetic particles may be particles comprised of fine particles having conductivity and magnetic properties and dispersed in a binder resin, as obtained by kneading the fine particles having conductivity and magnetic properties, together with the binder resin described later and by shaping the kneaded product into particles. Also, the magnetic particles may be made to have such construction that such conductive magnetic particles are further coated with a resin. In such construction, ferrite particles may preferably be used. As the composition of ferrite, those containing a metallic element such as copper, zinc, manganese, magnesium, iron, lithium, strontium or barium may preferably be used.

The binder resin to be used in the interiors of the magnetic particles may include homopolymers or copolymers of styrenes such as styrene and chlorostyrene; monoolefins such as ethylene, propylene, butylene and isobutylene; vinyl esters such as vinyl acetate, vinyl propionate, vinyl benzoate and vinyl lactate; a-methylene aliphatic monocarboxylates such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ethers such as methyl vinyl ether, ethyl vinyl ether and butyl vinyl ether; vinyl ketones such as methyl vinyl ketone, hexyl vinyl ketone and isopropenyl vinyl ketone. In particular, in view of dispersibility of conductive fine particles and productivity, preferred are polystyrene, a styrene-alkyl acrylate copolymer, a styrene-acrylonitrile copolymer, a styrene-butadiene copolymer, a styrene-maleic anhydride copolymer, polyethylene and polypropylene. Also preferred are polycarbonate, phenol resins, polyesters, polyurethanes, epoxy resins, polyolefins, fluorine resins, silicone resins and polyamides.

Here, the fluorine resins may include, e.g., solvent-soluble copolymers obtained by polymerization of polyvinyl fluoride, polyvinylidene fluoride, polytrifluoroethylene, polychlorotrifluoroethylene, polydichlorodifluoroethylene, polytetrafluoroethylene or polyhexafluoropropylene with other monomers.

The magnetic particles may preferably have a saturation magnetization of from 15 to 70 $Am^2/kg$. If the magnetic particles have a saturation magnetization higher than 70 $Am^2/kg$, they may provide so large a magnetic binding force as to make the ears of the magnetic brush too hard to move freely, tending to cause faulty charging because of a lowering of their performance of contact with the photosensitive member or wear the photosensitive member (drum) because of the hard ears of the magnetic brush. If the magnetic particles have a saturation magnetization lower than 15 $Am^2/kg$, they may provide so small a magnetic binding force as not to return to the magnetic brush after they have moved to the photosensitive member (drum), so that, because of a decrease of particles, the charging may deteriorate and the steps of development, transfer and fixing may adversely be affected.

In the present invention, the saturation magnetization is measured with a vibration magnetic force meter VSM-3S-15 (manufactured by Toei Kogyo) under application of a magnetic field of 79.6 kA/m (1 k oersteds), and the amount of its magnetization is regarded as the saturation magnetization.

The magnetic particles in the present invention may preferably be in such a form that the particles have surface layers for the purpose of regulating the resistance and controlling the polarity of triboelectric charging to toner.

The form of such surface layers is to cover the surfaces of magnetic particles with vacuum deposited films, resin films, conductive resin films or resin films having a conducting agent dispersed therein, or to coat the surfaces with a coupling agent or the like.

The surface layers need not necessarily cover or coat the magnetic particles completely, and the magnetic particles may stand partly uncovered as long as the effect of the present invention can be obtained. Namely, the surface layers may be formed in a discontinuous form.

For the resin film as the surface layer of the magnetic particles, a binder resin is used. The binder resin may include, like those for the interiors of the magnetic particles, homopolymers or copolymers of styrenes such as styrene and chlorostyrene; monoolefins such as ethylene, propylene, butylene and isobutylene; vinyl esters such as vinyl acetate, vinyl propionate, vinyl benzoate and vinyl lactate; a-methylene aliphatic monocarboxylates such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ethers such as methyl vinyl ether, ethyl vinyl ether and butyl vinyl ether; vinyl ketones such as methyl vinyl ketone, hexyl vinyl ketone and isopropenyl vinyl ketone. In particular, in view of film forming properties as coat layers and productivity, preferred are polystyrene, a styrene-alkyl acrylate copolymer, a styrene-acrylonitrile copolymer, a styrene-butadiene copolymer, a styrene-maleic anhydride copolymer, polyethylene and polypropylene. Also preferred are polycarbonate, phenol resins, polyesters, polyurethanes, epoxy resins, polyolefins, fluorine resins, silicone resins and polyamides.

Here, the fluorine resins may include, e.g., solvent-soluble copolymers obtained by polymerization of polyvinyl fluoride, polyvinylidene fluoride, polytrifluoroethylene, polychlorotrifluoroethylene, polydichlorodifluoroethylene, polytetrafluoroethylene or polyhexafluoropropylene with other monomers.

The resin films having a conducting agent dispersed therein may be obtained by dispersing a conducting agent in the above binder resin. The conducting agent may include metals such as copper, nickel, iron, aluminum, gold and silver, metal oxides such as iron oxide, ferrite, zinc oxide, tin oxide, antimony oxide and titanium oxide, and also electron-conductive conducting powders such as carbon black. It may further include, as ionic conducting agents, lithium perchlorate and quaternary ammonium salts.

The coupling agent may include titanate type coupling agents such as isopropoxytriisostearoyl titanate, dihydroxybis(lactato)titanium and diisopropoxybis (acetylacetonato)titanium; aluminum type coupling agents such as acetoalkoxyaluminum diisopropylate; and silane type coupling agents such as dimethylaminopropyltrimethoxysilane, n-octadecyldimethylmethoxysilane, n-hexyltriethoxysilane, 3-aminopropyltrimethoxysilane and n-octadecyltrimethoxysilane. A functional group such as an amino group or fluorine may also appropriately be introduced into it. In the case of the coupling agent, very thin coating films (at a molecular level) are formed on the magnetic particle surfaces, and hence may have less influence on the resistance value of the magnetic particles. Accordingly, any treatment for resistance regulation need not be made on the coat layers as long as the resistance of cores which are the magnetic particles is regulated.

As a second embodiment of the charging means in the present invention, the charging means has a conductive fine powder and a charging member holding the conductive fine powder on its surface; the conductive fine powder forming the part of contact with the a-Si photosensitive member; and is a charging means for charging the a-Si photosensitive member electrostatically upon application of a voltage to the charging member.

The charging member may be any conductive member without any particular limitations as long as it can hold on its surface the conductive fine powder in such a way that the conductive fine powder can be brought into contact with the surface of the a-Si photosensitive member. Any known form may be used which is constituted of a mandrel which may preferably be non-magnetic, and a charging layer formed of resin which is provided around this mandrel.

The charging member may be constituted of an elastic material having a porous-material surface. This is preferable in order to hold the conductive fine powder on its surface. The charging member in the present invention may also preferably be a roller member having an Asker-C hardness of 50 degrees or lower, and more preferably from 25 degrees or higher to 50 degrees or lower. Any too low hardness may make the roller member have so unstable a shape as to come into poor contact with the charging object member (photosensitive member). Also, the conductive fine powder interposed at the part of contact between the roller member and the photosensitive member may abrade or scratch the roller member surface, so that no stable charging performance may be attained. On the other hand, any too high hardness not only may make it impossible to ensure the charging contact zone between the roller member and the charging object member, but also may make poor the former's accurate contact with the surface of the latter.

The charging member may also preferably be a roller member having a volume resistivity of from $1\times10^3$ to $1\times10^8$ Ω•cm. If the charging member has a volume resistivity lower than $1\times10^3$ Ω•cm, the voltage may leak when any defective portions such as pinholes are present in the charging object member. If the charging member has a volume resistivity higher than $1\times10^8$ Ω•cm, it may be impossible to charge the charging object member sufficiently.

The charging layer of the charging member as described above may be formed of any of conventionally known various resin compounds. Such resin compounds may include, e.g., natural rubbers (vulcanized ones); rubber compounds such as ethylene-propylene rubbers (EPDM), styrene-butadiene rubbers (SBR), silicone rubbers, urethane rubbers, isoprene rubbers (IR), butyl rubbers (BR), nitrile-butadiene rubbers (NBR) and chloroprene rubbers (CR); and thermoplastic elastomers such as polyolefin type thermoplastic elastomers, urethane type thermoplastic elastomers, polystyrene type thermoplastic elastomers, fluorine rubber type thermoplastic elastomers, polyester type thermoplastic elastomers, polyamide type thermoplastic elastomers, polybutadiene type thermoplastic elastomers, ethylene-vinyl acetate type thermoplastic elastomers, polyvinyl chloride type thermoplastic elastomers and chlorinated polyethylene type thermoplastic elastomers. Any of these materials may be used alone or in the form of a mixture of two or more types, or in the form of a copolymer.

The charging layer formed using any of these resin compounds may be endowed with an appropriate conductivity by, e.g., dispersing conductive particles in the layer. Such conductive particles may include, e.g., carbon black, conductive metal oxides, alkali metal salts and ammonium salts.

In the case when the charging layer is formed using any of the above resin compounds and when the charging layer is formed as an elastic material having a porous-material surface, any known technique may be employed. Such a technique is exemplified by the foaming of elastic materials. Also, the hardness of the resultant charging member may be regulated by any known technique, e.g., by the above foaming or by adding a softening oil or a plasticizer.

The hardness of the charging member can be measured with an Asker-C rubber hardness meter, manufactured by Kohbunshi Keiki K.K. Stated more specifically, rubber hardness at arbitrary five points on the charging member surface is measured, and its average value at the five points is regarded as the hardness of the charging member.

The volume resistivity of the charging member can be measured with, e.g., a resistance-measuring device (an insulation resistance meter Hiresta-UP, manufactured by Mitsubishi Chemical Industries Ltd.). Stated more specifically, the charging layer material itself is formed in a film of 2 mm thick, and a voltage of 10 V is applied thereto for 1 minute in an environment of 23° C./55% RH to measure its conductivity. When measured, the same elastic composition as that used to form the charging layer is made into a coating material, and its clear coating material is coated on an aluminum sheet, and the conductivity of the charging layer is measured under the above conditions.

The conductive fine powder may preferably have a resistivity of $1\times10^{9}$ Ω•cm or lower. If the conductive fine powder has a resistivity higher than $1\times10^{9}$ Ω•cm, the effect of accelerating charging for the achievement of good charging performance tends to be not obtainable even when the conductive fine powder is interposed at the part of contact between the charging member and the electrophotographic photosensitive member or at a charging region vicinal to that part. Also, the conductive fine powder may have a resistivity of $1\times10^{-1}$ Ω•cm or higher. This is preferable because in this case the conductive fine powder comes to hold charges and moves to non-image areas in the developing step and in consequence, it accelerates the charging of the photosensitive member in the subsequence charging step.

The conductive fine powder may preferably have a volume-average particle diameter of from 0.5 to 10 μm. If the conductive fine powder has an average particle diameter smaller than 0.5 μm, the content of the conductive fine powder with respect to the whole toner must be set small in order to prevent developing performance from lowering. From this point of view, the conductive fine powder may preferably have a volume-average particle diameter of 0.8 μm or larger, and more preferably 1.1 μm or larger. Also, if the conductive fine powder has a volume-average particle diameter larger than 10 μm, the conductive fine powder having come off from the charging member may intercept or diffuse the exposure light with which electrostatic latent images are written, tending to cause defects in electrostatic latent images to lower image quality level.

The conductive fine powder may also be a transparent, white or pale-color conductive fine powder. This is preferable because the conductive fine powder transferred onto the transfer medium is not conspicuous as fog. In the sense that it does not obstruct the exposure light in the step of forming latent images, too, the conductive fine powder may preferably be such a transparent, white or pale-color conductive fine powder, and the conductive fine powder may more preferably have a transmittance of 30% or higher to the exposure light.

As materials for the above conductive fine powder, usable are, e.g., fine carbon powders such as carbon black and graphite powder; fine powders of metals such as copper, gold, silver, aluminum and nickel; fine powders of metal oxides such as zinc oxide, titanium oxide, tin oxide, aluminum oxide, indium oxide, silicon oxide, magnesium oxide, barium oxide, molybdenum oxide, iron oxide and tungsten oxide; and fine powders of metal compounds such as molybdenum sulfide, cadmium sulfide and potassium titanate, or double oxides of these; any of which may be used under optional regulation of particle size and particle size distribution. Of these, fine powders of metal oxides such as zinc oxide, tin oxide and titanium oxide are preferred.

For the purpose of controlling resistance value of conductive inorganic oxides, also usable are fine particles of metal oxides doped with an element such as antimony or aluminum, and fine particles having a conductive material on their surfaces. For example, they are fine titanium oxide particles surface-treated with tin-antimony oxide, fine stannic oxide particles doped with antimony, and fine stannic oxide particles.

The resistivity of the conductive fine powder can be measured by, e.g., the tablet method. In the measurement by the tablet method, first, a cell is filled with the conductive fine powder, and opposing electrodes are provided in contact with the conductive fine powder, where a voltage is applied cross the electrodes, and the electric current flowing there is measured. Measuring conditions in this case are as follows: In an environment of 23° C./65% RH, the conductive fine powder and the electrodes are kept in contact in a contact area of 2 $cm^2$ and the conductive fine powder is put in a thickness of 1 mm, under application of a load of 10 kg to the upper electrode and at an applied voltage of 100 V.

The volume-average particle diameter and particle size distribution of the conductive fine powder in the present invention can be measured with an LS-230 type laser diffraction particle size distribution measuring instrument, manufacture by Coulter Co., fitted with a liquid module, and in the measurement range of 0.04 to 2,000 μm. As a measuring method, a method is available in which a surface-active agent is added in a very small quantity to 10 ml of pure water, 10 mg of a conductive fine powder sample is added thereto, the mixture formed is dispersed for 10 minutes by means of an ultrasonic dispersion machine (ultrasonic homogenizer) and thereafter measurement is made once for a measurement time of 90 seconds.

In addition to the charging member and conductive fine powder described above, the charging means according to the present embodiment may further have a conductive fine powder replenishing means which holds the conductive fine powder therein and feeds the conductive fine powder to the charging member surface. Such a replenishing means may include, e.g., a container having an opening which faces the charging member. This container may also be provided therein with an agitation and transport means (e.g., a rotating blade and a conveyor) for agitating and transporting the conductive fine powder held in the container.

The charging means as described above may charge the a-Si photosensitive member while it moves with a difference in relative speed with respect to the surface of the a-Si photosensitive member. This is preferable in order to charge the photosensitive member uniformly. Also, the charging means may charge the a-Si photosensitive member while the charging member and the a-Si photosensitive member move in the direction opposite to each other at their contact zone. This is preferable for the like reason.

Specific examples of the charging member according to the second embodiment, used in the present invention, are described below with reference to the drawings.

Figure 6:
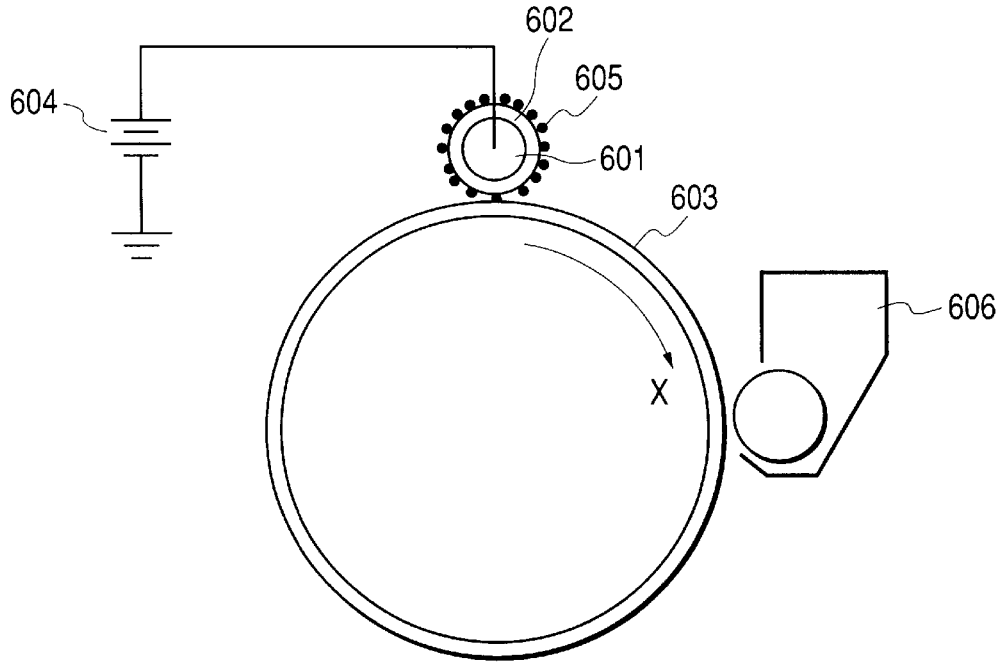
FIG. 6 is a schematic illustration of another example of a contact charging unit used in the image-forming apparatus of the present invention.

FIG. 6 diagrammatically illustrates an image-forming apparatus in which an elastic roller having the conductive fine powder interposed at the contact zone is used as a charging member of the contact charging unit. This elastic-roller charging unit is a charging means having a charging member comprising a mandrel 601 formed of a conductive material, and provided thereon a charging elastic layer 602 which is formed of an elastic material having a porous-material surface, such as a sponge, and a conductive fine powder 605 made to adhere to its surface. In this charging means, the conductive fine powder 605 interposed between the elastic layer 602 of the charging member and a photosensitive member 603 improves the state of contact, and affords a charging unit improved in the injection of electric charges by charging.

A voltage application means 604 is connected to the mandrel 601, and a direct-current voltage Vdc is applied to the charging member elastic layer 602 via the mandrel 601, where electric charges are directly injected through the conductive fine powder 605 interposed at the part of contact between the charging member and the surface of the photosensitive member 603. Thus, the photosensitive member surface is uniformly charged. The elastic-roller charging member is rotated and moved at an appropriate relative speed with respect to the rotational direction X of he photosensitive member 603. The elastic-roller charging member may also be kept vibrated with respect to the photosensitive member 603.

In the FIG. 6 diagrammatic illustration, shown is a cleanerless image-forming apparatus. The latent image formed by charging and exposure is rendered visible by means of a developing assembly 606, and is transferred to a transfer medium by a transfer means (not shown). In that course, the transfer residual toner having remained on the photosensitive member 603 is charged by the elastic-roller charging assembly and thereafter again reaches the developing assembly 606, where the transfer residual toner having been transported on the photosensitive member is collected simultaneously with the development performed using the fresh developer. In the FIG. 6 diagrammatic illustration, shown is an embodiment in which the conductive fine powder 605 interposed between the charging member and the photosensitive member is externally added to the toner, and the conductive fine powder 605 having remained on the photosensitive member 603 surface reaches the charging assembly, where it replenishes the conductive fine powder.

Figure 7:
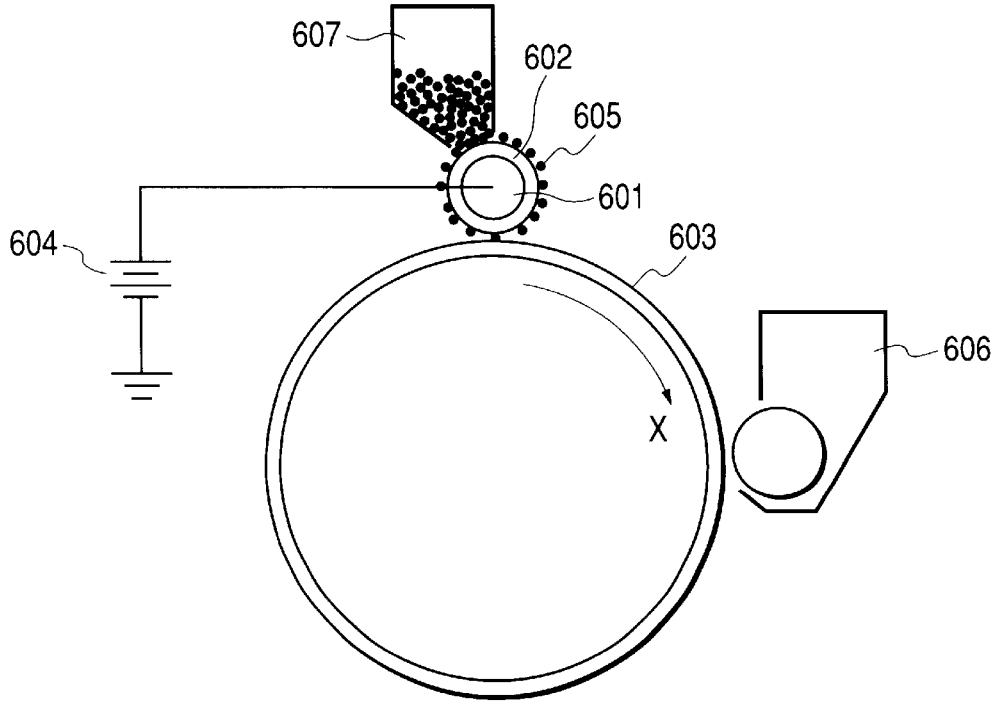
FIG. 7 is a schematic illustration of still another example of a contact charging unit used in the image-forming apparatus of the present invention.

FIG. 7 shows the same charging unit as that shown in FIG. 6, except that a conductive fine powder replenishing means for supplying the conductive fine powder 605 is further provided at the upper part of the charging member. Other construction is the same as that of the charging unit shown in FIG. 6.

(4) Toner in the present invention:

The toner in the present invention is a magnetic toner comprising toner particles containing at least a binder resin and a magnetic material, and an inorganic fine powder.

The toner used in the present invention does not require any limitations to its production process as long as the conditions of the present invention described later are fulfilled. Any production processes known conventionally may be used. Such toner production processes can be exemplified by a pulverization process and a polymerization process.

In the case when the toner is produced by pulverization, any known method may be used. For example, components necessary as the toner, such as a binder resin, a magnetic material, a release agent, a plasticizer, a charge control agent and a colorant and other additives are thoroughly mixed by mean of a mixer such as a Henschel mixer or a ball mill, thereafter the mixture obtained is melt-kneaded by means of a heat kneading machine such as a heat roll, a kneader or an extruder to make resins melt one another, other toner materials such as a magnetic material are dispersing or dissolved, and the resultant product is cooled to solidify, followed by pulverization, classification and optionally surface treatment to obtain toner particles. Either of the classification and the surface treatment may be first in order. In the step of classification, a multi-division classifier may preferably be used in view of production efficiency.

The pulverization step may be carried out by any method making use of a known pulverizer such as a mechanical impact type or a jet type. In order to obtain toner particles having a specific circularity according to the present invention, described later, it is preferable to further apply heat to effect pulverization or to add mechanical impact auxiliarily to make treatment. Also usable are a hot-water bath method in which toner particles finely pulverized (and optionally classified) are dispersed in hot water, and a method in which such toner particles are passed through hot-air streams.

As means for applying mechanical impact force, available are, e.g., a method making use of a mechanical impact type pulverizer such as Kryptron system, manufactured by Kawasaki Heavy Industries, Ltd., or Turbo mill, manufactured by Turbo Kogyo K. K., and a method in which toner particles are pressed against the inner wall of a casing by centrifugal force by means of a high-speed rotating blade to impart mechanical impact to the magnetic toner particles by the force such as compression force or frictional force, as exemplified by apparatus such as a mechanofusion system manufactured by Hosokawa Mikuron K. K. or a hybridization system manufactured by Nara Kikai Seisakusho. When such a mechanical impact method is used, thermomechanical impact where heat is applied at a temperature around glass transition temperature (Tg) of the magnetic toner particles (Tg±10° C.) as treatment temperature is preferred from the viewpoint of prevention of agglomeration and productivity. More preferably the heat may be applied at a temperature within ±5° C. of the glass transition temperature (Tg) of the magnetic toner particles, as being effective for the improvement of transfer efficiency.

The toner used in the present invention may be produced by pulverization as described previously. However, the toner particles obtained by such pulverization commonly have an amorphous shape, and hence any mechanical and thermal or any special treatment must be made in order to attain preferable physical properties, an average circularity of 0.950 or more, which is an essential requirement for the toner according to the present invention as will be detailed later. Accordingly, in the present invention, the toner particles may preferably be produced by suspension polymerization.

In this suspension polymerization, a polymerizable monomer and a colorant (and also optionally a polymerization initiator, a cross-linking agent, a charge control agent and other additives) are uniformly dissolved or dispersed to form a polymerizable monomer composition, and thereafter this polymerizable monomer composition is dispersed in a continuous phase (e.g., an aqueous phase) containing a dispersion stabilizer, by means of a suitable stirrer to simultaneously carry out polymerization to obtain toner particles having the desired particle diameters. In the toner obtained by this suspension polymerization (hereinafter also "polymerization toner"), its individual toner particles stand uniform in a substantially spherical shape, and hence the toner which satisfies the requirement on physical properties, the average circularity of 0.950 or more, which is essential for the present invention can be obtained with ease. Moreover, such a toner can also have a relatively uniform charge quantity distribution, and hence has a high transfer performance.

In the process of producing the toner particles according to the present invention by polymerization, a magnetic material, a wax, a plasticizer, a charge control agent, a cross-linking agent, components necessary as the toner in some cases, such as a colorant and other additives, e.g., an organic solvent added in order to lower the viscosity of a polymer formed by the polymerization reaction, a high-molecular polymer, a dispersant and so forth are appropriately added, and are dissolved or dispersed by means of a dispersion machine such as a homogenizer, a ball mill, a colloid mill or an ultrasonic dispersion machine to form a polymerizable monomer composition, which is then suspended in an aqueous medium containing a dispersion stabilizer. Here, a high-speed dispersion machine such as a high-speed stirrer or an ultrasonic dispersion machine may be used to make the toner particles have the desired particle size without delay, and this can more readily make the resultant toner particles have a sharp particle size distribution. As the time at which the polymerization initiator is added, it may be added simultaneously when other additives are added in the polymerizable monomer, or may be mixed immediately before they are suspended in the aqueous medium. Also, a polymerization initiator having been dissolved in the polymerizable monomer or solvent may be added before the polymerization is initiated. As these materials, the following materials may be used which are usually used in the production of toners.

The toner used in the present invention has toner particles containing at least a binder resin and a magnetic material, and an inorganic fine powder. As the binder resin, it may include polystyrene; homopolymers of styrene derivatives such as polyvinyl toluene; styrene copolymers such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer, a styrene-maleic acid copolymer and a styrene-maleate copolymer; and polymethyl methacrylate, polybutyl methacrylate, polyvinyl acetate, polyethylene, polypropylene, polyvinyl butyral, silicone resins, polyester resins, polyamide resins, epoxy resins, polyacrylic acid resins, rosins, modified rosins, terpene resins, phenolic resins, aliphatic or alicyclic hydrocarbon resins, and aromatic petroleum resins. Any of these may be used alone or in combination of two or more types.

The polymerizable monomer preferably used in the suspension polymerization may include, e.g., styrene; styrene monomers such as o-methylstyrene, m-methylstyrene, p-methylstyrene, p-methoxystyrene and p-ethylstyrene; acrylic esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylic esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and other monomers such as acrylonitrile, methacrylonitrile and acrylamides. Any of these monomers may be used alone or in combination of two or more types. Of the foregoing monomers, styrene or a styrene derivative may preferably be used alone or in the form of a mixture with other monomer, in view of developing performance and running performance of the toner.

The polymerization initiator, usable when the above polymerizable monomer(s) is/are polymerized, may include, e.g., azo or diazo type polymerization initiators such as 2,2'-azobis-(2,4-dimethylvaleronitrile), 2,2'-azobisisobutyronitrile, 1,1'-azobis-(cyclohexane-1-carbonitrile), and 2,2'-azobis-4-methoxy-2,4-dimethylvaleronitrile; and peroxide type polymerization initiators such as benzoyl peroxide, methyl ethyl ketone peroxide, diisopropylperoxy carbonate, cumene hydroperoxide, 2,4-dichlorobenzoyl peroxide, lauroyl peroxide and t-butyl peroxy-2-ethyl hexanoate. Any of these may be used alone or in combination of two or more types.

As the cross-linking agent, usable when the above polymerizable monomer(s) is/are polymerized, compounds chiefly having at least two polymerizable double bonds may be used, which are conventionally known cross-linking agents of various types. It may include, e.g., aromatic divinyl compounds such as divinyl benzene and divinyl naphthalene; carboxylic acid esters having two double bonds such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups. Any of these may be used alone or in combination of two or more types.

As the dispersion stabilizer, usable preferably in the suspension polymerization, any known surface-active agent and organic or inorganic dispersant may be used. In particular, an inorganic dispersant may preferably be used because it may hardly cause any harmful ultrafine powder and the dispersion stability is attained by its steric hindrance and hence it may hardly loose its stability even when the reaction temperature is changed, and is so readily washable as to hardly adversely affect the toner particles.

The surface-active agent may include, e.g., sodium dodecylbenzenesulfonate, sodium tetradecyl sulfate, sodium pentadecyl sulfate, sodium octyl sulfate, sodium oleate, sodium laurate, sodium stearate and potassium stearate. Any of these may be used alone or in combination of two or more types.

The organic dispersant may include, e.g., polyvinyl alcohol, gelatin, methyl cellulose, methyl hydroxypropyl cellulose, ethyl cellulose, carboxymethyl cellulose sodium salt, polyacrylic acid and salts thereof, and starch. Any of these may be used alone or in combination of two or more types.

The inorganic dispersant may include, e.g., phosphoric acid polyvalent metal salts such as calcium phosphate, magnesium phosphate, aluminum phosphate and zinc phosphate; carbonates such as calcium carbonate and magnesium carbonate; inorganic salts such as calcium metasilicate, calcium sulfate and barium sulfate; and inorganic oxides such as calcium hydroxide, magnesium hydroxide, aluminum hydroxide, silica, bentonite and alumina. Any of these may be used alone or in combination of two or more types.

In the toner used in the present invention, a wax which regulates releasability and plasticity may be used. Such a wax may include petroleum waxes such as paraffin wax, microcrystalline wax and petrolatum and derivatives thereof, montan wax and derivatives thereof, hydrocarbon waxes obtained by Fischer-Tropsch synthesis and derivatives thereof, polyolefin waxes typified by polyethylene wax and derivatives thereof, and naturally occurring waxes such as carnauba wax and candelilla wax and derivatives thereof. The derivatives include oxides, block copolymers with vinyl monomers, and graft modified products. Also usable are higher aliphatic alcohols, fatty acids such as stearic acid and palmitic acid, or compounds thereof, acid amide waxes, ester waxes, ketones, hardened caster oil and derivatives thereof, vegetable waxes, and animal waxes. Any of these may be used alone or in combination of two or more types.

In the toner used in the present invention, a charge control agent which controls the chargeability of the toner may be used. Such a charge control agent may include, as negative charge control agents, e.g., metal compounds of aromatic carboxylic acids such as salicylic acid, alkylsalicylic acids, dialkylsalicylic acids, naphthoic acid and dicarboxylic acid; metal salts or metal complexes of azo dyes or azo pigments; and polymer type compounds having sulfonic acid or carboxylic acid in the side chain; as well as boron compounds, urea compounds, silicon compounds, and carixarene. Any of these may be used alone or in combination of two or more types. As positive charge control agents, they may include, e.g., quaternary ammonium salts, polymer type compounds having such a quaternary ammonium salt in the side chain, guanidine compounds, nigrosine compounds and imidazole compounds. Any of these may be used alone or in combination of two or more types.

In the toner used in the present invention, a colorant may optionally be used. Such a colorant may include, e.g., magnetic or non-magnetic inorganic compounds and known dyes and pigments. Stated more specifically, it may include, e.g., ferromagnetic metal particles such as cobalt and nickel, or alloys of any of these metals to which element(s) such as chromium, manganese, copper, zinc, aluminum and/or rare earth element(s) has or have been added; as well as hematite particles, titanium black, nigrosine dyes or pigments, carbon black, and phthalocyanines. Any of these may be used alone or in combination of two or more types. Also, the colorant may be used after it has been subjected to hydrophobic treatment like the magnetic material or inorganic fine powder described later.

As the magnetic material contained in the toner used in the present invention, any known magnetic material may be used. Such a magnetic material may include, e.g., those composed chiefly of triiron tetraoxide or γ-iron oxide. Any of these may be used alone or in combination of two or more types. The magnetic material may further contain any of other elements such as phosphorus, cobalt, nickel, copper, magnesium, manganese, aluminum and silicon. Incidentally, the saturation magnetization may be regulated by selecting the type of the magnetic material to be used and the amount of the magnetic material to be mixed.

It is preferable for the magnetic material to have been hydrophobic-treated on its particle surfaces. It may be hydrophobic-treated with a known treating agent and by a known method. The treating agent used in such hydrophobic treatment may include coupling agents such as silane coupling agents and titanium coupling agents, which combine with particle surfaces of the magnetic material while hydrolyzing in an aqueous medium. In particular, silane coupling agents are preferred. Such silane coupling agents may include, e.g., vinyltrimethoxysilane, vinyltriethoxysilane, γ-methacryloxypropyltrimethoxysilane, vinyltriacetoxysilane, methyltrimethoxysilane, methyltriethoxysilane, isobutyltrimethoxysilane, dimethyldimethoxysilane, dimethyldiethoxysilane, trimethylmethoxysilane, hyroxypropyltrimethoxysilane, phenyltrimethoxysilane, n-hexadecyltrimethoxysilane and n-octadecyltrimethoxysilane. Any of these may be used alone or in combination of two or more types.

In the step of polymerization, the polymerization may be carried out at a polymerization temperature set at 40° C. or above, and commonly at a temperature of from 50 to 90° C. Where the polymerization is carried out in this temperature range, the wax becomes more favorably enclosed in particles. In order to consume residual polymerizable monomers, the reaction temperature may be raised to 90 to 150° C. if it is done at the termination of polymerization reaction.

The toner particles according to the present invention may also be produced by a dispersion polymerization method in which toner particles are directly produced using an aqueous organic solvent capable of dissolving monomers and not capable of dissolving the resulting polymer, a method of producing toner particles by an emulsion polymerization method as typified by soap-free polymerization in which toner particles are produced by direct polymerization in the presence of a water-soluble polar polymerization initiator, or a method in which polymer particles obtained by emulsion polymerization are subjected to association agglomeration.

After the polymerization has been completed, the resultant polymerization toner particles may be subjected to filtration, washing and drying by conventional methods, followed by blending with the inorganic fine powder to make it adhere to particle surfaces to obtain the toner. Also, it is one of desirable forms of the present invention to add the step of classification to cut coarse powder and fine powder.

The magnetic toner in the present invention may preferably have an average circularity of from 0.950 to 1.000, more preferably from 0.950 to 0.995, and still more preferably from 0.970 to 0.995.

The average circularity referred to in the present invention is used as a simple method for expressing the shape of toner quantitatively. In the present invention, the shape of particles is measured with a flow type particle image analyzer FPIA-1000, manufactured by Toa Iyou Denshi K. K., and circularity (Ci) is individually calculated on a group of particles having a circle-equivalent diameter of 3 μm or larger, according to the following Equation (V). As also further shown in the following Equation (VI), the value obtained when the sum total of circularity of all particles measured is divided by the number (m) of all particles is defined to be the average circularity (C).

$$\text{Circularity } (Ci) = \frac{\text{Circumferential length of a circle with the same area as particle image}}{\text{Circumferential length of particle projected image}} \quad \text{Equation (V)}$$

$$\text{Average circularity } (C) = \sum_{i=1}^{m} Ci/m \quad \text{Equation (VI)}$$

The measuring device "FPIA-1000" used in the present invention employs a calculation method in which, in calculating the circularity of each particle and thereafter calculating the average circularity, particles are divided into 61 classes as circularities of from 0.40 to 1.00, in accordance with the corresponding circularities, and the average circularity are calculated using the center values and frequencies of divided points. Between the values of the average circularity calculated by this calculation method and the values of the average circularity calculated by the above calculation equation which uses the circularity of each particle directly, there is only a very small accidental error, which is at a level that is substantially negligible. Accordingly, in the present invention, such a calculation method in which the concept of the calculation equation which uses the circularity of each particle directly is utilized and is partly modified may be used, for the reasons of handling data, e.g., making the calculation time short and making the operational equation for calculation simple.

The measurement is specifically made in the manner as shown below.

In 10 ml of water in which about 0.1 mg of a surface-active agent has been dissolved, about 5 mg of the toner is dispersed to prepare a dispersion. Then the dispersion is exposed to ultrasonic waves (20 kHz, 50 W) for 5 minutes and the dispersion is made to have a concentration of 5,000 to 20,000 particles/$\mu$l, where the measurement is made using the above analyzer to determine the average circularity of the group of particles having a circle-equivalent diameter of 3 $\mu$m or larger.

The average circularity referred to in the present invention is an index showing the degree of surface unevenness of toner particles. It is indicated as 1.000 when the toner particles are perfectly spherical. The more complicate the surface shape of toner particles is, the smaller the value of average circularity is. Incidentally, in this measurement, the reason why the circularity is measured only on the group of particles having a circle-equivalent diameter of 3 $\mu$m or larger is that a group of particles of external additives that is present independently from toner particles are included in a large number in a group of particles having a circle-equivalent diameter smaller than 3 $\mu$m, which may affect the measurement not to enable any accurate estimation of the circularity on the group of toner particles.

The toner in the present invention can be obtained by blending the above toner particles with the inorganic fine powder to make the inorganic fine powder adhere to the toner particle surfaces. The inorganic fine powder used in the toner may preferably be in an amount of from 0.1 to 3.0% by weight based on the total weight of the toner. If it is in an amount less than 0.1% by weight, the effect (such as improvement of a fluidity and charging performance of the toner) attributable to such external addition of the inorganic fine powder can not well be brought out in some cases. If it is blended in an amount more than 3.0% by weight, a poor fixing performance may result.

The inorganic fine powder thus used may include, e.g., fine silica powder, fine alumina powder and fine titania powder, which may be used alone or in combination of two or more types. Stated more specifically, as the fine silica powder for example, usable are what is called dry-process silica or fumed silica produced by vapor phase oxidation of silicon halides and what is called wet-process silica produced from water glass, either of which may be used. The dry-process silica is preferred, as having less silanol groups on the surface and inside of particles of the fine silica powder and leaving less production residues such as $Na_2O$ and $SO_{32-}$. In the dry-process silica, it is also possible to use, in its production step, other metal halide compound as exemplified by aluminum chloride or titanium chloride together with the silicon halide to give a composite fine powder (double oxide) of silica with other metal oxide. The inorganic fine powder includes these, too.

It is also preferable for the inorganic fine powder to have been hydrophobic-treated. A hydrophobic-treating agent used for hydrophobic-treating the inorganic fine powder may include treating agents such as silicone varnish, modified silicone varnish of various types, silicone oil, modified silicone oil of various types, silane compounds, silane coupling agents, other organic silicon compounds and organic titanium compounds, any of which may be used alone or in combination for the treatment. In particular, those having been treated with silicone oil are preferred.

As a method for treating the inorganic fine powder with the silicone oil, stated specifically, for example the inorganic fine powder having been treated with a silane compound and the silicone oil may directly be mixed by means of a mixer such as a Henschel mixer, or a method may be used in which the silicone oil is sprayed on the inorganic fine powder. Alternatively, a method may be used in which the silicone oil is dissolved or dispersed in a suitable solvent and thereafter the inorganic fine powder is added and mixed, followed by removal of the solvent. In view of an advantage that agglomerates of the inorganic fine powder may relatively less occur, the method making use of a sprayer is preferred.

As the silicone oil used, particularly preferred are, e.g., dimethylsilicone oil, methylphenylsilicone oil, $\alpha$-methylstyrene-modified silicone oil, chlorophenylsilicone oil and fluorine-modified silicone oil.

The magnetic toner in the present invention may preferably have a saturation magnetization of from 10 to 50 $Am^2/kg$ (emu/g) under application of a magnetic field of 79.6 kA/m (1,000 oersteds).

However, if the magnetic toner has a saturation magnetization lower than 10 $Am^2/kg$ under application of a magnetic field of 79.6 kA/m, any intended effect is not obtainable, and, where a magnetic force is made to act on the toner-carrying member, the toner may unstably be formed into ears, tending to cause faulty images such as fog and uneven image density and faulty collection of transfer residual toner which are ascribable to non-uniform charging to the magnetic toner. If on the other hand the magnetic toner has a saturation magnetization higher than 50 $Am^2/kg$ under application of a magnetic field of 79.6 kA/m, the toner may have a low fluidity because of magnetic agglomeration to cause a great lowering of the fluidity of the toner. This may cause a lowering of transfer performance to cause an increase in transfer residual toner, and also may make stronger the tendency for the toner particles and conductive fine powder to behave jointly to lessen the conductive fine powder adhering to and mixing in the contact charging member and standing interposed at the contact zone, and at the same time lessen the conductive fine powder interposed at the contact zone, as its quantity with respect to the quantity of transfer residual toner, tending to cause fog and image stains because of a lowering of charging performance.

In the present invention, the intensity of magnetization (saturation magnetization) of the magnetic toner is measured with a vibration type magnetic-force meter VSM P-1-10 (manufactured by Toei Kogyo K. K.) under application of an external magnetic field of 79.6 kA/m at room temperature of 25° C. Incidentally, in the present invention, the saturation magnetization of the toner is prescribed in the magnetic field of 79.6 kA/m. In the case when the magnetic toner is applied in the image-forming apparatus, the magnetic filed acting on the magnetic toner is set at tens to hundred and tens of kA/m in many commercially available image-forming apparatus in order not to greatly cause any leakage of the magnetic field to the outside of the image-forming apparatus or in order to cut down the cost for magnetic-field generation sources. Accordingly, in the present invention, the magnetic field of 79.6 kA/m (1,000 oersteds) is selected as a typical value of the magnetic filed acting actually on the magnetic toner in the image-forming apparatus. Thus, the saturation magnetization of the toner in the magnetic field of 79.6 kA/m is prescribed here.

(5) Image-forming method and image-forming apparatus of the present invention:

The image-forming method of the present invention may be the same method as any conventional methods except for using the above electrophotographic photosensitive member, charging means and magnetic toner according to the present invention.

An embodiment of the image-forming apparatus of the present invention is described with reference to FIG. 8. The present invention is by no means limited to this. Also, the image-forming apparatus of the present invention has the same means as any means used in known image-forming apparatus except for using the above electrophotographic photosensitive member, charging means and magnetic toner according to the present invention.

Figure 8:
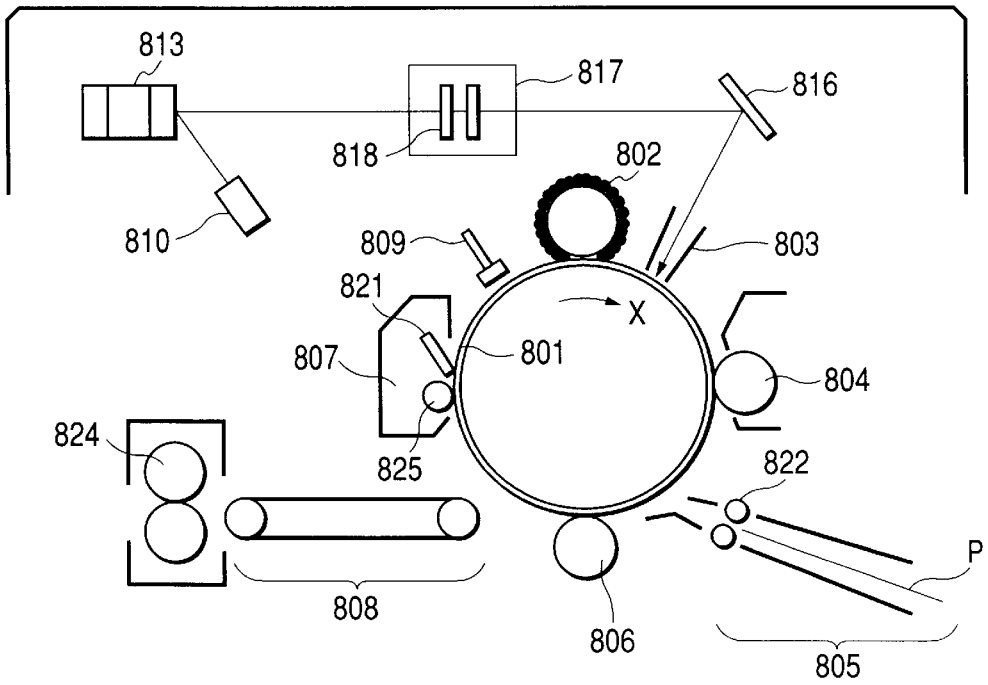
FIG. 8 is a schematic illustration of an example of the image-forming apparatus of the present invention.

FIG. 8 schematically illustrates an example of an image-forming process in the image-forming apparatus of the present invention. An electrophotographic photosensitive member 801comprises an a-C:H surface layer having the arithmetic-mean roughness of 100 nm or lower, and is rotated in the direction of an arrow X. The electrophotographic photosensitive member 801 is provided around it with a contact charging assembly 802 according to the present invention, an electrostatic latent image forming means 803, a developing assembly 804, a transfer medium feed system 805, a transfer means transfer roller 806, a cleaner 807, a transport system 808 and a charge elimination light source 809.

The image-forming process is specifically described below. The electrophotographic photosensitive member 801 is uniformly electrostatically charged by the contact charging assembly 802 to which a negative direct-current voltage (DC) or a charging voltage formed by superimposing an alternating voltage (AC) on the negative direct-current voltage (DC) is kept applied. Laser light emitted from a semiconductor laser 810 which is driven in accordance with image information having been read by a scanner or image information inputted from a computer reflects from a polygon mirror 813, and an image is formed through a lens 818 of a lens unit 817. This image is led onto the electrophotographic photosensitive member 801 via a mirror 816 and projected thereon, thus an electrostatic latent image is formed. To this latent image, a toner with negative polarity is fed from the developing assembly 804, so that a toner image is formed.

Meanwhile, a transfer medium P is passed through a transfer paper feed system 805 and fed toward the electrophotographic photosensitive member 801 while its leading-end timing is regulated by a registration roller 822. The transfer medium P is provided from its back with an electric field having a polarity opposite to that of the toner, at a gap between the transfer roller 806 to which a high voltage is kept applied and the electrophotographic photosensitive member 801. Thus, the toner image on the electrophotographic photosensitive member surface is transferred to the transfer medium P. Next, the transfer medium P passes through the transfer medium transport system 808 to reach a fixing assembly 824, where the toner image is fixed, and then delivered out of the apparatus.

The toner remaining on the electrophotographic photosensitive member 801 is collected with a magnet roller 825 and a cleaning blade 821 which are provided in the cleaning unit (cleaner) 807. The remaining electrostatic latent image is erased by the charge elimination light source 809.

In the case of the step of cleaning-at-development, the cleaning unit 807 is not necessarily be required, and the toner remaining on the electrophotographic photosensitive member 801 is collected by the developing assembly 804 after it has passed the charging assembly 802. In this case, the elastic-roller charging assembly is used as the charging assembly 802.

EXAMPLES

The present invention is described below in greater detail by giving Examples. The present invention is by no means limited to these Examples. In the present Examples, "part(s)" is "part(s) by weight".

Example 1

Production of Photosensitive Member

Using the apparatus for producing the a-Si photosensitive member by RF plasma-assisted CVD as shown in FIG. 2, a lower-part blocking layer, a photoconductive layer and a buffer layer were superposingly formed on a mirror-finished aluminum cylinder as a conductive substrate, in the manner as described in the photosensitive member production process in the above embodiments and under conditions shown below. A surface layer comprised of a-C:H was further formed thereon to produce six photosensitive members in total, for negative charging. Here, the frequency of RF power used was 13.56 MHz.

At the same time, under conditions shown below, samples of surface layers were formed on silicon wafers, and their infrared absorption spectra were measured with an infrared spectrophotometer. Then, in-film hydrogen content was determined from the area of an absorption peak of C-Hn appearing at 2,920 $cm^{-1}$ vicinity and the layer thickness. As the result, the hydrogen content with respect to total content in the carbon film (H/(C+H)) was 45 atomic %.

(1) Lower-part blocking layer:

| | |
|---|---|
| $SiH_4$ | 300 ml/min (normal*) |
| $H_2$ | 600 ml/min (normal) |
| NO | 10 ml/min (normal) |
| $PH_3$ | 2,000 ppm (based on $SiH_4$) |
| Power | 200 W |
| Discharge space pressure | 80 Pa |

-continued

| | |
|---|---|
| Substrate temperature | 250° C. |
| Layer thickness | 3 μm |
| (2) Photoconductive layer: | |
| $SiH_4$ | 450 ml/min (normal) |
| $H_2$ | 450 ml/min (normal) |
| Power | 500 W |
| Discharge space pressure | 66.5 Pa |
| Substrate temperature | 250° C. |
| Layer thickness | 25 μm |
| (3) Buffer layer: | |
| $SiH_4$ | 50 ml/min (normal) |
| $CH_4$ | 500 ml/min (normal) |
| $B2H_6$ | 500 ppm (based on $SiH_4$) |
| Power | 200 W |
| Discharge space pressure | 53 Pa |
| Substrate temperature | 250° C. |
| Layer thickness | 0.2 μm |
| (4) Surface layer: | |
| $CH_4$ | 200 ml/min (normal) |
| Power | 1,000 W |
| Discharge space pressure | 73 Pa |
| Substrate temperature | 200° C. |
| Layer thickness | 0.5 μm |

*(0° C., atmospheric pressure)

On the photosensitive members thus obtained, their arithmetic-mean roughness was regulated by means of the surface-polishing apparatus shown in FIG. 4, to obtain photosensitive members (A) to (F) whose arithmetic-mean roughness Ra was changed in the range of from 5 nm to 100 nm.

Production of Toner

Next, polymerization toner (1) was produced in the following way.

Into 709 g of ion-exchanged water, 451 g of an aqueous 0.1 M-$Na_3PO_4$ solution was introduced, and the mixture was heated to 60° C. Thereafter, 67.7 g of an aqueous 1.0 M-$CaCl_2$ solution was added thereto little by little to obtain an aqueous medium containing $Ca_3(PO_4)_2$.

| | |
|---|---|
| Styrene | 80 parts |
| 2-Butyl acrylate | 20 parts |
| Unsaturated polyester resin | 2 parts |
| Saturated polyester resin | 3 parts |
| Negative charge control agent (monoazo dye type Fe compound) | 1 part |
| Surface hydrophobic-treated magnetic material | 90 parts |

The above materials were uniformly dispersed and mixed by means of an attritor (manufactured by Mitsui Miike Engineering Corporation) to obtain a monomer composition. This monomer composition was heated to 60° C., and 6 parts of ester wax (maximum value of endothermic peak in DSC: 72° C.) composed chiefly of behenyl behenate was added thereto and mixed to become dissolved. In the mixture obtained, 5 parts of a polymerization initiator 2,2'-azobis(2,4-dimethylvaleronitrile) ($t_{1/2}$: 140 minutes, under 60° C. condition) was dissolved to prepare a polymerizable monomer composition.

The polymerizable monomer composition thus obtained was introduced into the above aqueous medium, followed by stirring at 10,000 rpm for 15 minutes at 60° C. in an atmosphere of $N_2$ by means of the TK-type homomixer (manufactured by Tokushu Kika Kogyo Co., Ltd.) to carry out granulation. Thereafter, with stirring with paddle stirring blades, the reaction was carried out at 60° C. for 6 hours. Then, the liquid temperature was raised to 80° C., and the stirring was further continued for 4 hours. After the reaction was completed, distillation was further carried out at 80° C. for 2 hours. Thereafter the suspension formed was cooled, and hydrochloric acid was added to dissolve the $Ca_3(PO_4)_2$, followed by filtration, washing with water and drying to obtain toner particles having a weight-average particle diameter of 6.5 μm.

100 parts of the toner particles thus obtained and 1.2 parts of hydrophobic fine silica powder obtained by surface-treating silica of 8 nm in primary particle diameter with hexamethyldisilazane and having a BET specific surface area of 250 $mm^2/g$ after the treatment were mixed by means of a Henschel mixer (manufactured by Mitsui Miike Engineering Corporation) to prepare the polymerization toner (1). The toner thus obtained had an average circularity of 0.983 and an intensity of magnetization (saturation magnetization) under application of a magnetic field of 79.6 kA/m, of 28 $Am^2/kg$.

Image-Forming Apparatus

The a-Si photosensitive member (A) to (F) each and polymerization toner (1) produced in the manner described above were set in the image-forming apparatus shown in FIG. 8, to which the magnetic-brush charging assembly shown in FIG. 5 in the above embodiments was attached. Here, the process speed was set at 400 mm/s; and the relative speed of the photosensitive member to the magnetic brush, 200% in opposite direction.

Magnetic particles used in the magnetic-brush charging assembly in the present Example were produced in the following way. 0.05% by weight of phosphorus was added to a mixture of 50 mole % of $Fe_2O_3$, 25 mole % of CuO and 25 mole % of ZnO, and a dispersant, a binder and water were added thereto. These were dispersed and mixed by means of a ball mill, followed by granulation by means a spray dryer and then molding. Next, the molded product obtained was fired for 6 hours under conditions of 1,150° C. The fired product obtained was disintegrated, followed by classification (using a dispersion separator) to obtain spherical ferrite particles of 35 μm in volume-average particle diameter.

In 100 parts of the magnetic particles obtained as described above, 0.10 parts of a titanium coupling agent (isopropoxytriisostearoyl titanate) was mixed by the aid of a toluene solvent, followed by wet-process coating and then curing at 170° C. in an electric oven. The volume resistivity of the resultant magnetic particles was $3.5\times10^7$ Ω•cm.

Evaluation was made on the photosensitive members (A) to (F) in the following way in respect of abrasion level, faulty cleaning, melt adhesion (of toner), coarse images, halftone unevenness and smeared images.

Abrasion Level

A 100,000-sheet running test was made using A4-size paper. Here, the layer thickness of the surface layer was measured by the interference type layer thickness measuring apparatus before and after the running test to measure its abrasion level. Then, the results were evaluated by four ranks according to the following criteria.

A: Within a measurement error, and no abrasion is detectable; very good.

B: Abrasion level is 5% or less; good.

C: Abrasion level is more than 5%, but at a level not problematic in practical use at all.

D: Abrasion occurred remarkably.

Evaluation on Faulty Cleaning

Cleaning performance was evaluated using photosensitive members and cleaning blade on which an A4-size paper 100,000-sheet running test was finished. As a method therefor, the pressure of the cleaning blade was lowered from the standard pressure 147 mN/cm (15 gf/cm) while images were reproduced, and the pressure at which faulty cleaning due to slip-off of toner occurred was measured.

A: No faulty cleaning occurs even at any pressure lower than 50% of the standard pressure; very good.

B: No faulty cleaning occurs even at pressure of 50% or higher to lower than 70% of the standard pressure; good.

C: No faulty cleaning occurs even at pressure of 70% or higher to lower than 90% of the standard pressure; at a level of no problem in practical use.

D: Faulty cleaning sometimes occurs even at the standard pressure.

Evaluation on Melt Adhesion

An A4-size paper continuous 20,000-sheet running test was made in an environment of 25° C./10% RH to make a melt adhesion acceleration test. Here, as an original, a single line chart was used in which a single 1 mm wide black line was printed in a shoulder sash. After the running test was finished, whole-area halftone images and whole-area white images were reproduced to observe any black dots caused by melt adhesion of toner. The photosensitive member surface was also observed on a microscope.

A: No melt adhesion is seen on both the images and the drum; very good.

B: Slight melt adhesion occurs during running, and appears and disappears repeatedly, but does not grow.

C: Slight melt adhesion occurs on the drum, but does not appear on the images.

D: Melt adhesion occurs which appears on the images.

Coarse Images

After an A4-size paper 100,000-sheet running test was finished, copies of a sample chart of a portrait image were taken, and the copied images obtained were visually checked with a magnifier of 10 magnifications. Then, the results were evaluated by four ranks according to the following criteria.

A: No coarse images are seen even when observed with the magnifier of 10 magnifications; very good.

B: Coarse images are slightly seen when observed with the magnifier of 10 magnifications, but are not seen when observed visually; good.

C: Coarse images are slightly seen at some part when observed visually, but at a level not problematic in practical use.

D: Coarse images are conspicuously seen when observed visually.

Halftone Unevenness

Copies of a halftone chart were taken, and the image density of copied images was measured at five spots in the axial direction of the photosensitive member to make evaluation. Here, the image density was measured with an image densitometer (Macbeth RD914). Evaluation was made according to the following criteria.

A: Scattering of image density is less than 10%; very good.

B: Scattering of image density is 10% or more to less than 15%; good.

C: Scattering of image density is 15% or more to less than 20%.

D: Scattering of image density is more than 20%.

Smeared Images

After an A4-size copy paper 100,000-sheet running test was finished, environmental conditions were changed to 35° C./85%. Leaving a whole day and night, images were reproduced soonest in the next morning to make evaluation on any smeared images. Here, any heating means for heating the photosensitive member was not used, and evaluation was made in the state it was kept at room temperature. Copies of a test chart available from CANON INC., consisting of whole-area characters on the white background (Parts No. FY9-9058) were taken, and copied images obtained were observed to make evaluation by examining whether or not fine lines of the images stood blurred. In this evaluation, when unevenness was seen on the images, it was examined in the whole image regions to make evaluation, and results in the worst areas were shown.

A: No smeared images are seen at all even when observed with a magnifier; very good.

B: Seen to have been smeared to an extent that it is recognizable when observed with a magnifier, but characters are legible without any difficulties at all; good.

C: Smeared images occur, and some characters are seen to have been smeared.

D: Smeared images occur greatly, and some characters are illegible.

Comparative Example 1

Using the apparatus for producing the a-Si photosensitive member by RF plasma-assisted CVD method as shown in FIG. 2, a lower-part blocking layer, a photoconductive layer and a buffer layer were superposingly formed on a mirror-finished aluminum cylinder, and a surface layer comprised of a-C:H was further superposingly formed thereon, under the same conditions as those shown in Example 1, to produce two a-Si photosensitive members in total. Here, the frequency of RF power used was 13.56 MHz.

On the photosensitive members thus obtained, their arithmetic-mean roughness was regulated to 120 nm and 140 nm by means of the surface-polishing apparatus shown in FIG. 4, to obtain photosensitive members (a) and (b), respectively. On the photosensitive members (a) and (b) obtained, evaluation was made in the same manner as in Example 1.

Comparative Example 2

Using the apparatus for producing the a-Si photosensitive member by RF plasma-assisted CVD method as shown in FIG. 2, a lower-part blocking layer, a photoconductive layer and a buffer layer were superposingly formed on a mirror-finished aluminum cylinder under the same conditions as those shown in Example 1. A surface layer comprised of a-SiC was further superposingly formed thereon under forming conditions shown below, to produce an a-Si photosensitive member. Here, the frequency of RF power used was 13.56 MHz.

At the same time, under conditions shown below, samples of surface layers were formed on silicon wafers, and their infrared absorption spectra were measured with an infrared spectrophotometer. Then, in-film hydrogen content was determined by totaling i) in-film hydrogen content determined from an absorption peak of C-Hn appearing at 2,920 $cm^{-1}$ vicinity and the layer thickness and ii) in-film hydrogen content determined from an absorption peak of Si-Hn appearing at 2,000 $cm^{-1}$ vicinity and the layer thickness. As the result, the hydrogen content with respect to total content in the carbon film (H/(C+H)) was 42 atomic %

| a-SiC:H Surface layer: | |
|---|---|
| $CH_4$ | 20 ml/min (normal) |
| $SiH_4$ | 400 ml/min (normal) |
| Power | 250 W |
| Discharge space pressure | 30 Pa |
| Substrate temperature | 250° C. |
| Layer thickness | 0.5 μm |

On the photosensitive member thus obtained, its arithmetic-mean roughness Ra was regulated to 20 nm by means of the surface-polishing apparatus shown in FIG. 4, to obtain a photosensitive member (c). On the photosensitive member (c) obtained, evaluation was made in the same manner as in Example 1.

The results of Example 1 and Comparative Examples 1 and 2 are shown in Table 1.

TABLE 1

| | Example 1 | | | | | | Comparative Example 1 | | Comparative Example 2 |
|---|---|---|---|---|---|---|---|---|---|
| Photosensitive member | A | B | C | D | E | F | a | b | c |
| Surface roughness Ra: (nm) | 5 | 20 | 40 | 60 | 80 | 100 | 120 | 140 | 20 |
| Abrasion level: | A | A | A | A | A | A | C | C | D |
| Faulty cleaning: | A | A | A | A | A | B | C | C | C |
| Melt adhesion: | A | A | A | A | A | A | A | A | C |
| Coarse images: | A | A | A | A | A | A | A | A | A |
| Halftone unevenness: | A | A | A | A | A | A | A | A | A |
| Smeared images: | A | A | A | A | A | A | A | A | A |

As can be seen from the results shown in Table 1, very stable results are obtainable by regulating the arithmetic-mean roughness Ra to 100 nm or smaller when the photosensitive member having the a-C:H surface layer, the contact charging and the polymerization toner are employed in combination.

Example 2

Using the apparatus for producing the a-Si photosensitive member by RF plasma-assisted CVD method as shown in FIG. 2, a lower-part blocking layer, a photoconductive layer and a buffer layer were superposingly formed on a mirror-finished aluminum cylinder, and a surface layer comprised of a-C:H was further superposingly formed thereon, in the same manner as in Example 1, to produce a photosensitive member.

On the photosensitive member thus obtained, the surface was etched under conditions shown below, to regulate its arithmetic-mean roughness Ra to 50 nm to obtain a photosensitive member (G). Here, the frequency of RF power used at the time of the etching was 13.56 MHz.

| Etching conditions: | |
|---|---|
| $CF_4$ | 500 ml/min (normal) |
| Power | 150 W |
| Discharge space pressure | 50 Pa |
| Substrate temperature | room temperature |
| Etching time | 10 minutes |

On the photosensitive member (G) obtained, evaluation was made in the same manner as in Example 1. Also, in the present Example, the magnetic carrier quantity of the magnetic-brush charging assembly was measured before and after the A4-size copy paper 100,000-sheet running test to examine the quantity of carrier leakage. Evaluation was made according to the following criteria.

A: The rate of decrease of the magnetic carrier is less than 2%; very good.

B: The rate of decrease of the magnetic carrier is 2% or more to less than 5%; good.

C: The rate of decrease of the magnetic carrier is 5% or more to less than 10%, and is no problem in practical use.

D: The rate of decrease of the magnetic carrier is 10% or more.

Comparative Example 3

Using the apparatus for producing the a-Si photosensitive member by RF plasma-assisted CVD method as shown in FIG. 2, a lower-part blocking layer, a photoconductive layer and a buffer layer were superposingly formed on a mirror-finished aluminum cylinder in the same manner as in Example 1. A surface layer comprised of a-SiC was further superposingly formed thereon under the same conditions as the formation of the surface layer in Comparative Example 2, to produce a photosensitive member.

On the photosensitive member thus obtained, the surface was etched in the same manner as in Example 2 to regulate its arithmetic-mean roughness Ra to 50 nm to obtain a photosensitive member (d).

On the photosensitive member (d) obtained, evaluation was made in the same manner as in Example 2.

The results of Example 2 and Comparative Example 3 are shown in Table 2.

TABLE 2

| | Example 2 | Comparative Example 3 |
|---|---|---|
| Photosensitive member: | G | d |
| Surface roughness Ra: (nm) | 50 | 50 |
| Abrasion level: | A | D |
| Faulty cleaning | A | D |
| Melt adhesion: | A | B |
| Coarse images: | A | A |
| Halftone unevenness: | A | A |
| Smeared images: | A | A |
| Carrier leakage: | A | C |

As can be seen from the results shown in Table 2, the lubricity of the surface layer brings about the effect of keeping the carrier from leaking when the photosensitive member having the a-C:H surface layer and the magnetic-brush charging assembly are employed in combination.

Example 3

Production of Photosensitive Member

Using the apparatus for producing the a-Si photosensitive member by VHF plasma-assisted CVD method as shown in FIG. 3, a lower-part blocking layer, a photoconductive layer, a buffer layer and a surface layer were superposingly formed on a mirror-finished aluminum cylinder as a conductive substrate under conditions shown below. Here, the frequency of VHF power used was 105 MHz.

At the same time, the in-film hydrogen content was determined in the same manner as in Example 1. As the result, the hydrogen content with respect to total content in the carbon film (H/(C+H)) was 58 atomic %.

| | |
|---|---|
| (1) Lower-part blocking layer: | |
| $SiH_4$ | 200 ml/min (normal) |
| $H_2$ | 500 ml/min (normal) |
| Power | 1,000 W |
| Discharge space pressure | 0.8 Pa |
| Substrate temperature | 290° C. |
| Layer thickness | 2 μm |
| (2) Photoconductive layer: | |
| $SiH_4$ | 200 ml/min (normal) |
| $H_2$ | 500 ml/min (normal) |
| Power | 1,000 W |
| Discharge space pressure | 0.8 Pa |
| Substrate temperature | 290° C. |
| Layer thickness | 30 μm |
| (3) Buffer layer: | |
| $SiH_4$ | 50 ml/min (normal) |
| $CH_4$ | 50 ml/min (normal) |
| $B_2H_6$ | 500 ppm (based on $SiH_4$) |
| Power | 1,000 W |
| Discharge space pressure | 0.8 Pa |
| Substrate temperature | 290° C. |
| Layer thickness | 0.3 μm |
| (4) Surface layer: | |
| $CH_4$ | 100 ml/min (normal) |
| Power | 1,800 W |
| Discharge space pressure | 0.8 Pa |
| Substrate temperature | 200° C. |
| Layer thickness | 0.5 μm |

On the photosensitive member thus obtained, the surface was etched using a high-frequency power of 105 MHz and under conditions shown below, to regulate its arithmetic-mean roughness Ra to 30 nm to obtain a photosensitive member (H).

| Etching conditions: | |
|---|---|
| $H_2$ | 500 ml/min (normal) |
| Power | 500 W |
| Discharge space pressure | 0.8 Pa |
| Substrate temperature | room temperature |
| Etching time | 10 minutes |

Production of Toner

Next, polymerization toner (2) was produced in the following way.

First, toner particles having a weight-average particle diameter of 6.4 μm were obtained in the same manner as the polymerization toner (1). Then, 100 parts of the toner particles thus obtained, 1.2 parts of hydrophobic fine silica powder obtained by treating silica of 12 nm in primary particle diameter with hexamethyldisilazane and thereafter with silicone oil and having a BET specific surface area of 140 $mm^2/g$ after the treatment were mixed by means of a Henschel mixer (manufactured by Mitsui Miike Engineering Corporation) to prepare the polymerization toner (2).

Image-Forming Apparatus

The photosensitive member and polymerization toner (2) thus obtained were set in the electrophotographic apparatus shown in FIG. 8, making use of the magnetic-brush charging assembly. Evaluation was made in the same manner as in Example 1.

The results of evaluation are shown in Table 3.

TABLE 3

| | Example 3 |
|---|---|
| Photosensitive member: | H |
| Surface roughness Ra: (nm) | 30 |
| Abrasion level: | A |
| Faulty cleaning: | A |
| Melt adhesion: | A |
| Coarse images: | A |
| Halftone unevenness: | A |
| Smeared images: | A |

As the result of Table 3, even though a-Si photosensitive member produced by VHF, the same technical advantages can be obtained.

Example 4

Production of Toner

Polymerization toner (3) was produced in the following way.

First, toner particles having a weight-average particle diameter of 6.4 μm were obtained in the same manner as the polymerization toner (1). Then, 100 parts of the toner particles thus obtained, 1.2 parts of hydrophobic fine silica powder obtained by surface-treating silica of 8 nm in primary particle diameter with hexamethyldisilazane and having a BET specific surface area of 250 $mm^2/g$ after the treatment, and 2 parts of fine zinc oxide powder were mixed by means of a Henschel mixer (manufactured by Mitsui Miike Engineering Corporation) to prepare the polymerization toner (3).

The toner thus obtained had an average circularity of 0.983 and an intensity of magnetization (saturation magnetization) under application of a magnetic field of 79.6 kA/m, of 28 $Am^2/kg$.

The fine zinc oxide powder used here comprises fine particles (resistivity: 1,500 Ω•cm; transmittance: 35%) having a volume-average particle diameter of 1.5 μm and containing 35% by volume of particles of 0.5 μm or smaller and 0% by number of particles of 5 μm or larger in particle size distribution, obtained by subjecting zinc oxide primary particles of 0.1 to 0.3 μm in primary-particle diameter to granulation under pressure and the resultant particles to air classification. Observation of this fine zinc oxide powder on a scanning electron microscope at 3,000 magnifications and 30,000 magnifications revealed that it was comprised of zinc oxide primary particles of 0.1 to 0.3 μm in diameter and agglomerates of 1 to 4 μm in diameter.

The a-Si photosensitive members (A) to (F) obtained in Example 1 and the polymerization toner (3) were set in the electrophotographic apparatus shown in FIG. 8, making use of the elastic-roller charging assembly having the conductive fine powder interposed at the contact zone as shown in FIG. 6.

As the charging member, a charging roller of 12 mm in diameter and 234 mm in length was produced as a flexible member, using as the mandrel a SUS stainless steel roller of 6 mm in diameter and 264 mm in length, and forming on the mandrel a medium-resistance foamed urethane layer in the form of a roller, further followed by cutting and polishing to regulate the shape and surface properties; the foamed urethane layer having carbon black dispersed therein as conductive particles and having been foamed using a curing agent and a blowing agent. The charging roller obtained has a resistivity of $10^5$ Ω•cm and a hardness of 30 degrees as Asker-C hardness.

In this image-forming apparatus, the conductive fine powder had been added to the polymerization toner (3), and the conductive fine powder 605 having remained on the photosensitive member 603 surface was so made as to reach the charging member to be fed there. The process speed was set at 400 mm/s; and the relative speed of the photosensitive member to the elastic roller, 200% in opposite direction.

Evaluation was made on the photosensitive members (A) to (F) in the following way in respect of abrasion level, image fog, coarse images, halftone unevenness and smeared images.

Abrasion Level

A 100,000-sheet running test was made using A4-size paper. Here, the layer thickness of the surface layer was measured by the interference type layer thickness measuring apparatus before and after the running test to measure its abrasion level. Then, the results were evaluated by four ranks according to the following criteria.

A: Within a measurement error, and no abrasion is detectable; very good.

B: Abrasion level is 5% or less; good.

C: Abrasion level is more than 5%, but at a level not problematic in practical use at all.

D: Abrasion occurred remarkably.

Evaluation on Image Fog

An original was prepared the left half of which was solid black and the right half of which was solid white. The solid black area side was first copied and immediately thereafter the solid white area side was copied so as to provide a situation where the image fog tended to occur. Then, the whiteness of the solid white area of the copied image and the whiteness of a transfer paper were measured with REFLECTOMETER MODEL TC-6DS (manufactured by Tokyo Denshoku K. K.), and fog density (%) was calculated from the density difference between them to make evaluation on the image fog. A green filter was used as a filter.

A: Very good (less than 1.0%).

B: Good (1.0% or more to less than 2.0%).

C: No problem in practical use (2.0% or more to less than 3.0%).

D: A little problematic (3.0% or more).

Coarse Images

Copies of a sample chart of a portrait image were taken, and the copied images obtained were visually checked with a magnifier of 10 magnifications. Then, the results were evaluated by four ranks according to the following criteria.

A: No coarse images are seen even when observed with the magnifier of 10 magnifications; very good.

B: Coarse images are slightly seen when observed with the magnifier of 10 magnifications, but are not seen when observed visually; good.

C: Coarse images are slightly seen at some part when observed visually, but at a level not problematic in practical use.

D: Coarse images are conspicuously seen when observed visually.

Halftone Unevenness

Copies of a halftone chart were taken, and the image density of copied images was measured at five spots in the axial direction of the photosensitive member to make evaluation. Here, the image density was measured with an image densitometer (Macbeth RD914). Evaluation was made according to the following criteria.

A: Scattering of image density is less than 10%; very good.

B: Scattering of image density is 10% or more to less than 15%; good.

C: Scattering of image density is 15% or more to less than 20%.

D: Scattering of image density is more than 20%.

Smeared Images

After an A4-size copy paper 100,000-sheet running test was finished, environmental conditions were changed to 35° C./85%. Leaving a whole day and night, images were reproduced soonest in the next morning to make evaluation on any smeared images. Here, any heating means for heating the photosensitive member was not used, and evaluation was made in the state it was kept at room temperature.

Copies of a test chart available from CANON INC., consisting of whole-area characters on the white background (Parts No. FY9-9058) were taken, and copied images obtained were observed to make evaluation by examining whether or not fine lines of the images stood blurred. In this evaluation, when unevenness was seen on the images, it was examined in the whole image regions to make evaluation, and results in the worst areas were shown.

A: No smeared images are seen at all even when observed with a magnifier; very good.

B: Seen to have been smeared to an extent that it is recognizable when observed with a magnifier, but characters are legible without any difficulties at all; good.

C: Smeared images occur, and some characters are seen to have been smeared, and no problem in a practical use.

D: Smeared images occur greatly, and some characters are illegible.

Comparative Example 4

The procedure of Example 4 was repeated except for using the photosensitive members (a) and (b) produced in Comparative Example 1. Evaluation was made in the same way.

Comparative Example 5

The procedure of Example 4 was repeated except for using the photosensitive member (c) produced in Comparative Example 2. Evaluation was made in the same way.

The results of Example 4 and Comparative Examples 4 and 5 are shown together in Table 4. As can be seen from the results shown in Table 4, very good results are obtainable by regulating the arithmetic-mean roughness Ra to 100 nm or smaller when the photosensitive member having the a-C:H surface layer, the contact charging and the polymerization toner are employed in combination.

TABLE 4

| | Example 4 | | | | | | Comparative Example 4 | | Comparative Example 5 |
|---|---|---|---|---|---|---|---|---|---|
| Photosensitive member: | A | B | C | D | E | F | a | b | c |
| Surface roughness Ra: (nm) | 5 | 20 | 40 | 60 | 80 | 100 | 120 | 140 | 20 |
| Abrasion level: | A | A | A | A | A | A | C | C | D |
| Image fog: | A | A | A | A | A | B | C | C | C |
| Coarse images: | A | A | A | A | A | A | A | A | A |
| Halftone unevenness | A | A | A | A | A | A | A | A | A |
| Smeared images: | A | A | A | A | A | A | A | A | A |

Example 5

Production of Toner

Polymerization toner (4) was produced in the following way.

First, toner particles having a weight-average particle diameter of 6.4 $\mu$m were obtained in the same manner as the polymerization toner (1). Then, 100 parts of the toner particles thus obtained, 1.2 parts of hydrophobic fine silica powder obtained by surface-treating silica of 12 nm in primary particle diameter with hexamethyldisilazane and thereafter with silicone oil and having a BET specific surface area of 140 $mm^2/g$ after the treatment, and 2 parts of fine zinc oxide powder were mixed by means of a Henschel mixer (manufactured by Mitsui Miike Engineering Corporation) to prepare the polymerization toner (4).

The a-Si Photosensitive member (G) produced in Example 2 and the polymerization toner (4) were set in the electrophotographic apparatus shown in FIG. 8, making use of the same elastic-roller charging assembly as that in Example 4, having the conductive fine powder interposed at the contact zone as shown in FIG. 6. The process speed was set at 400 mm/s; and the relative speed of the photosensitive member to the elastic roller, 220% in opposite direction.

Evaluation was made in the same manner as in Example 4. In the present Example, an A4-size paper 100,000-sheet running test was also made to measure the outer diameter of the elastic roller before and after the running test to examine its wear level. Evaluation was made according to the following criteria.

A: The rate of decrease in outer diameter is less than 2%; very good.

B: The rate of decrease in outer diameter is 2% or more to less than 5%; good.

C: The rate of decrease in outer diameter is 5% or more to less than 10%, and no problem in practical use.

D: The rate of decrease in outer diameter is 10% or more.

Comparative Example 6

The procedure of Example 5 was repeated except for using the photosensitive member (d) produced in Comparative Example 3. Evaluation was made in the same way.

The results of Example 5 and Comparative Example 6 are shown in Table 5. As can be seen from the results shown in Table 5, the elastic roller can be kept from wearing when the photosensitive member having the a-C:H surface layer is combined with contact charging.

TABLE 5

| | Example 5 | Comparative Example 6 |
|---|---|---|
| Photosensitive member: | G | d |
| Surface roughness Ra: (nm) | 50 | 50 |
| Abrasion level: | A | D |
| Image fog: | A | D |
| Coarse images: | A | A |
| Halftone unevenness: | A | A |
| Smeared images: | A | A |
| Charging member wear level: | A | D |

Example 6

The a-Si Photosensitive member (H) produced in Example 3 was set in the electrophotographic apparatus shown in FIG. 8, making use of the elastic-roller charging assembly so constructed to have the conductive fine powder interposed at the contact zone as shown in FIG. 7. This was used in combination with the polymerization toner (3) to make evaluation in the same manner as in Example 4. The charging means shown in FIG. 7 is so constructed that the conductive fine powder 605 is supplied by the replenishing unit 607 provided at the upper part of the sponge-roller charging assembly.

The results of evaluation are shown in Table 6. As can be seen from the results shown in Table 6, the present invention is likewise effective also when the a-Si photosensitive member having the a-C:H surface layer produced by VHF plasma-assisted CVD is used.

TABLE 6

| | Example 3 |
|---|---|
| Photosensitive member: | H |
| Surface roughness Ra: (nm) | 30 |
| Abrasion level: | A |
| Faulty cleaning: | A |
| Coarse images: | A |
| Halftone unevenness: | A |
| Smeared images: | A |

What is claimed is:

1. An image-forming apparatus comprising:

an electrophotographic photosensitive member having a conductive substrate, and at least a photoconductive layer and a surface layer on the conductive substrate;

a charging means for charging the electrophotographic photosensitive member electrostatically;

a latent-image-forming means for performing imagewise exposure to form an electrostatic latent image on the electrophotographic photosensitive member;

a developing means for moving a toner to the electrostatic latent image formed on the electrophotographic photosensitive member, to render the electrostatic latent image visible to form a toner image; and a transfer means for transferring the toner image to a transfer medium;

wherein;

the photoconductive layer of said electrophotographic photosensitive member comprises a non-single-crystal material composed chiefly of silicon;

the surface layer of said electrophotographic photosensitive member comprises a non-single-crystal carbon film containing at least hydrogen, and has an arithmetic-mean roughness Ra ranging from 0 nm to 100 nm in an extent of 10 $\mu$m×10 $\mu$m of the surface layer;

said charging means is a magnetic-brush charging assembly for charging said electrophotographic photosensitive member electrostatically upon application of a voltage, bringing a magnetic brush formed by binding magnetic particles magnetically into contact with the surface of said electrophotographic photosensitive member; and said toner is a magnetic toner having toner particles containing at least a binder resin and a magnetic material, and an inorganic fine powder, and having an average circularity of from 0.950 to 1.000;

said toner having a saturation magnetization of from 10 to 50 $Am^2/kg$ (emu/g) under application of a magnetic field of 79.6 kA/m (1,000 oersteds).

2. The image-forming apparatus according to claim 1, wherein said surface layer of said electrophotographic photosensitive member has an arithmetic-mean roughness Ra ranging from 5 nm to 80 nm in an extent of 10 $\mu$m×10 $\mu$m of the surface layer.

3. The image-forming apparatus according to claim 1, wherein said photosensitive layer of said electrophotographic photosensitive member contains at least one element selected from the group consisting of hydrogen and a halogen.

4. The image-forming apparatus according to claim 1, wherein said non-single-crystal carbon film has a hydrogen content of from 41 atomic % to 60 atomic % based on the total content in the carbon film.

5. The image-forming apparatus according to claim 1, wherein said electrophotographic photosensitive member is provided with a buffer layer between the photoconductive layer and the surface layer;

said buffer layer comprising a non-single-crystal material composed chiefly of silicon, containing at least one element selected from the group consisting of hydrogen and a halogen, and further contains at least one atom selected from the group consisting of carbon, oxygen and nitrogen.

6. The image-forming apparatus according to claim 5, wherein said buffer layer further contains at least one atom of atoms belonging to Group 3B and Group 5B of the periodic table.

7. The image-forming apparatus according to claim 1, wherein said surface layer is a layer formed by deposition carried out by decomposing at least a hydrocarbon gas by plasma-assisted chemical vapor deposition method making use of a high frequency of from 1 MHz to 450 MHz.

8. The image-forming apparatus according to claim 1, wherein said surface layer is a layer formed by deposition carried out by decomposing at least a hydrocarbon gas by plasma-assisted chemical vapor deposition method making use of a high frequency of 13.56 MHz or 105 MHz.

9. The image-forming apparatus according to claim 1, wherein said magnetic particles have a volume-average particle diameter of from 10 $\mu$m to 50 $\mu$m.

10. The image-forming apparatus according to claim 1, wherein said magnetic particles have a volume resistivity of from $1\times10^4$ Ω•cm to $1\times10^9$ Ω•cm.

11. The image-forming apparatus according to claim 1, wherein said magnetic particles further have surface layers on their surfaces.

12. The image-forming apparatus according to claim 1, wherein said toner has an average circularity of from 0.950 to 0.995.

13. The image-forming apparatus according to claim 1, wherein the inorganic fine powder contained in said toner has been hydrophobic-treated.

14. The image-forming apparatus according to claim 1, wherein the inorganic fine powder contained in said toner has been hydrophobic-treated with a silicone oil.

15. An image-forming method comprising:

a charging step of electrostatically charging an electrophotographic photosensitive member having a conductive substrate, and at least a photoconductive layer and a surface layer on the conductive substrate;

a latent-image-forming step of performing imagewise exposure to form an electrostatic latent image on the electrophotographic photosensitive member;

a developing step of moving a toner to the electrostatic latent image formed on the electrophotographic photosensitive member, to render the electrostatic latent image visible to form a toner image; and a transfer step of transferring the toner image to a transfer medium;

wherein;

the photoconductive layer of said electrophotographic photosensitive member comprises a non-single-crystal material composed chiefly of silicon;

the surface layer of said electrophotographic photosensitive member comprises a non-single-crystal carbon film containing at least hydrogen, and has an arithmetic-mean roughness Ra ranging from 0 nm to 100 nm in an extent of 10 $\mu$m×10 $\mu$m of the surface layer;

the charging step is a charging step making use of a magnetic-brush charging assembly for charging said electrophotographic photosensitive member electrostatically upon application of a voltage, bringing a magnetic brush formed by binding magnetic particles magnetically into contact with the surface of said electrophotographic photosensitive member; and said toner is a magnetic toner having toner particles containing at least a binder resin and a magnetic material, and an inorganic fine powder, and having an average circularity of from 0.950 to 1.000;

said toner having a saturation magnetization of from 10 to 50 $Am^2/kg$ (emu/g) under application of a magnetic field of 79.6 kA/m (1,000 oersteds).

16. An image-forming apparatus comprising:

an electrophotographic photosensitive member having at least a conductive substrate, and a photoconductive layer and a surface layer which are superposingly formed on the conductive substrate;

a charging means for charging the electrophotographic photosensitive member electrostatically;

a latent-image-forming means for performing imagewise exposure to form an electrostatic latent image on the electrophotographic photosensitive member;

a developing means for rendering the electrostatic latent image visible by the use of a toner to form a toner image; and a transfer means for transferring the toner image to a transfer medium;

wherein;

the photoconductive layer of said electrophotographic photosensitive member comprises a non-single-crystal material composed chiefly of silicon;

the surface layer of said electrophotographic photosensitive member comprises a non-single-crystal carbon film containing at least hydrogen, and has an arithmetic-mean roughness Ra ranging from 0 nm to 100 nm in an extent of 10 $\mu$m×10 $\mu$m of the surface layer;

said charging means has a conductive fine powder and a charging member holding the conductive fine powder on its surface; said conductive fine powder forming the part of contact with said electrophotographic photosensitive member; and is a charging means for charging said electrophotographic photosensitive member electrostatically upon application of a voltage to said charging member; and said toner is a magnetic toner having toner particles containing at least a binder resin and a magnetic material, and an inorganic fine powder, and having an average circularity of from 0.950 to 1.000;

said toner having a saturation magnetization of from 10 to 50 $Am^2/kg$ (emu/g) under application of a magnetic field of 79.6 kA/m (1,000 oersteds).

17. The image-forming apparatus according to claim 16, wherein said surface layer of said electrophotographic photosensitive member has an arithmetic-mean roughness Ra ranging from 5 nm to 80 nm in an extent of 10 $\mu$m×10 $\mu$m of the surface layer.

18. The image-forming apparatus according to claim 16, wherein said photoconductive layer of said electrophotographic photosensitive member contains at least one element selected from the group consisting of hydrogen and a halogen.

19. The image-forming apparatus according to claim 16, wherein said non-single-crystal carbon film has a hydrogen content of from 41 atomic % to 60 atomic % based on the total content in the carbon film.

20. The image-forming apparatus according to claim 16, wherein said electrophotographic photosensitive member is provided with a buffer layer between the photoconductive layer and the surface layer;

said buffer layer comprising a non-single-crystal material composed chiefly of silicon, containing at least one element selected from the group consisting of hydrogen and a halogen, and further contains at least one atom selected from the group consisting of carbon, oxygen and nitrogen.

21. The image-forming apparatus according to claim 20, wherein said buffer layer further contains at least one atom of atoms belonging to Group 3B and Group 5B of the periodic table.

22. The image-forming apparatus according to claim 16, wherein said surface layer is a layer formed by deposition carried out by decomposing at least a hydrocarbon gas by plasma-assisted chemical vapor deposition method making use of a high frequency of from 1 MHz to 450 MHz.

23. The image-forming apparatus according to claim 16, wherein said surface layer is a layer formed by deposition carried out by decomposing at least a hydrocarbon gas by plasma-assisted chemical vapor deposition method making use of a high frequency of 13.56 MHz or 105 MHz.

24. The image-forming apparatus according to claim 16, wherein said charging means is to charge said electrophotographic photosensitive member while the surface of said charging member moves keeping a difference in relative speed with respect to the surface of said electrophotographic photosensitive member at the part of contact between them.

25. The image-forming apparatus according to claim 16, wherein said charging member is to charge said electrophotographic photosensitive member while said charging member and said electrophotographic photosensitive member move in the direction opposite to each other at the part of contact between them.

26. The image-forming apparatus according to claim 16, wherein said charging member comprises an elastic material having a porous-material surface.

27. The image-forming apparatus according to claim 16, wherein said charging member is a roller member having an Asker-C hardness of 50 degrees or less.

28. The image-forming apparatus according to claim 16, wherein said charging member is a roller member having an Asker-C hardness of from 25 degrees to 50 degrees.

29. The image-forming apparatus according to claim 16, wherein said charging member is a roller member having a volume resistivity of from $1\times10^3$ Ω•cm to $1\times10^8$ Ω•cm.

30. The image-forming apparatus according to claim 16, wherein said conductive fine powder has a resistivity of $1\times10^9$ Ω•cm or lower.

31. The image-forming apparatus according to claim 16, wherein said developing means serves also as a cleaning means which collects transfer residual toner having remained on the surface of said electrophotographic photosensitive member.

32. The image-forming apparatus according to claim 16, wherein said magnetic toner has a conductive fine powder on its particle surfaces, and the conductive fine powder adheres to said electrophotographic photosensitive member when the toner image is formed on said electrophotographic photosensitive member, remains on said electrophotographic photosensitive member after the toner image has been transferred to the transfer medium, and is carried thereon to reach said charging means.

33. The image-forming apparatus according to claim 16, wherein said charging means has a conductive fine powder replenishing means which holds said conductive fine powder therein and feeds said conductive fine powder to the surface of the charging member.

34. The image-forming apparatus according to claim 16, wherein said toner has an average circularity of from 0.950 to 0.995.

35. The image-forming apparatus according to claim 16, wherein the inorganic fine powder contained in said toner has been hydrophobic-treated.

36. The image-forming apparatus according to claim 16, wherein the inorganic fine powder contained in said toner has been hydrophobic-treated with a silicone oil.

37. An image-forming method comprising:

a charging step of electrostatically charging an electrophotographic photosensitive member having a conductive substrate, and at least a photoconductive layer and a surface layer on the conductive substrate;

a latent-image-forming step of performing imagewise exposure to form an electrostatic latent image on the electrophotographic photosensitive member; a developing step of rendering the electrostatic latent image visible by the use of a toner to form a toner image; and a transfer step of transferring the toner image to a transfer medium;

wherein;

the photoconductive layer of said electrophotographic photosensitive member comprises a non-single-crystal material composed chiefly of silicon;

the surface layer of said electrophotographic photosensitive member comprises a non-single-crystal carbon film containing at least hydrogen, and has an arithmetic-mean roughness Ra ranging from 0 nm to 100 nm in an extent of 10 $\mu$m×10 $\mu$m of the surface layer;

said charging step is a charging step of applying a voltage to a charging member to charge said electrophotographic photosensitive member electrostatically by means of a charging member holding a conductive fine powder on its surface; said conductive fine powder forming the part of contact with said electrophotographic photosensitive member; and said toner is a magnetic toner having toner particles containing at least a binder resin and a magnetic material, and an inorganic fine powder, and having an average circularity of from 0.950 to 1.000;

said toner having a saturation magnetization of from 10 to 50 $Am^2/kg$ (emu/g) under application of a magnetic field of 79.6 kA/m (1,000 oersteds).

* * * * *

UNITED STATES PATENT AND TRADEMARK OFFICE

CERTIFICATE OF CORRECTION

PATENT NO. : 6,645,688 B2
DATED : November 11, 2003
INVENTOR(S) : Hashizume et al.

It is certified that error appears in the above-identified patent and that said Letters Patent is hereby corrected as shown below:

Column 2,
Line 32, "transfer" should read -- transferred --.

Column 3,
Line 53, "so" should read -- such --.

Column 4,
Line 67, "wherein;" should read -- wherein --.

Column 5,
Line 39, "wherein;" should read -- wherein --.

Column 6,
Lines 14 and 53, "wherein;" should read -- wherein --.

Column 10,
Line 29, "group" should read -- Group --.

Column 12,
Line 14, "(nm)" should read -- (nm). --.

Column 13,
Line 23, "$CHC1F_2$." should read -- $CHC1F_2$, --.

Column 15,
Line 23, "$NO_2$,$NO_2$," should read -- $NO_2$, $O_2$, --.

Column 19,
Line 56, "is" (first occurrence) should read -- it --.

Column 20,
Line 31, "a-methylene" should read -- α-methylene --.

Column 23,
Line 46, "subsequence" should read -- subsequent --.

Column 26,
Line 8, "mean" should read -- means --.

UNITED STATES PATENT AND TRADEMARK OFFICE

CERTIFICATE OF CORRECTION

PATENT NO. : 6,645,688 B2
DATED : November 11, 2003
INVENTOR(S) : Hashizume et al.

It is certified that error appears in the above-identified patent and that said Letters Patent is hereby corrected as shown below:

Column 27,
Line 31, "As" should read -- At --.

Column 32,
Line 32, "$SO_{32}$-" should read -- $SO_3^{2-}$ --.

Column 33,
Line 41, "801comprises" should read -- 801 comprises --.

Column 36,
Line 34, "way. 0.05%" should read -- way. ¶ 0.05% --.

Signed and Sealed this

Twenty-fourth Day of August, 2004

JON W. DUDAS
*Director of the United States Patent and Trademark Office*